US011213153B1

(12) United States Patent
Gooden et al.

(10) Patent No.: US 11,213,153 B1
(45) Date of Patent: Jan. 4, 2022

(54) STORAGE DEVICE FOR HATS AND/OR CAPS

(71) Applicants: Weldon J. Gooden, Lakewood, CA (US); William H. Stutz, Jr., Eagle Rock, CA (US); Billy Chang, Bradbury, CA (US)

(72) Inventors: Weldon J. Gooden, Lakewood, CA (US); William H. Stutz, Jr., Eagle Rock, CA (US); Billy Chang, Bradbury, CA (US)

( * ) Notice: Subject to any disclaimer, the term of this patent is extended or adjusted under 35 U.S.C. 154(b) by 0 days.

(21) Appl. No.: 17/118,628

(22) Filed: Dec. 11, 2020

(51) Int. Cl.
*A45C 11/02* (2006.01)
*A47G 25/10* (2006.01)

(52) U.S. Cl.
CPC ..... *A47G 25/10* (2013.01); *A45C 11/02* (2013.01)

(58) Field of Classification Search
CPC ..... A45C 11/02; A45C 13/005; A45C 13/103; A47G 25/10
USPC ..... 206/8; 211/30; 220/4.23; 24/385
See application file for complete search history.

(56) References Cited

U.S. PATENT DOCUMENTS

| | | | | |
|---|---|---|---|---|
| 870,550 | A | 11/1907 | Dod | |
| 1,577,632 | A | 3/1926 | Coles | |
| 1,606,811 | A | 11/1926 | Schilke | |
| 2,049,026 | A | 7/1936 | Savard | |
| 2,693,275 | A | 11/1954 | Smith | |
| 2,758,332 | A * | 8/1956 | Augensen, Jr. ..... | A45C 13/005 16/374 |
| 3,402,807 | A | 9/1968 | Hatcher, Jr. | |
| 5,022,515 | A | 6/1991 | Agostine | |
| 5,172,837 | A | 12/1992 | Finney, Jr. et al. | |
| 5,214,802 | A | 6/1993 | McCallum | |
| D344,233 | S | 2/1994 | Peters | |
| 5,348,166 | A | 9/1994 | Lema | |
| 5,480,023 | A | 1/1996 | Puller | |
| 6,125,997 | A | 10/2000 | Campbell | |
| 6,394,299 | B1 * | 5/2002 | Hupp ..... | B65D 43/162 220/315 |
| 6,510,972 | B1 | 1/2003 | Briskey | |
| 6,612,472 | B1 | 9/2003 | Zakarin | |
| 7,147,112 | B2 | 12/2006 | Penson | |
| 7,568,589 | B2 * | 8/2009 | Vovan ..... | B65D 55/024 220/4.23 |
| 8,177,104 | B2 | 5/2012 | Bryant | |
| 10,273,075 | B2 | 4/2019 | Brantley | |
| 10,433,625 | B1 | 10/2019 | Belizaire | |

(Continued)

*Primary Examiner* — Sue A Weaver
(74) *Attorney, Agent, or Firm* — Hoang Steve Ngo

(57) ABSTRACT

The embodiments of the present invention relate to storage devices for hats and/or caps that allow for organizing the hats and/or caps into space saving arrangements. The embodiments comprise an outer shell that is formed in part by a movable closure that allows for access to the interior of the shell for the purpose of placing hats and/or caps in the outer shell and/or removing hats and/or caps from the outer shell. In some embodiments of the present invention, the storage device includes means for being hung on a hanging rod or pole that is usually positioned in a closet and/or for being hung on a hanging member, device or apparatus that may be positioned behind a door, on a wall, or in any applicable position or arrangement. In some embodiments, the storage device includes means for hanging other similar storage devices from the storage device of the present invention.

20 Claims, 23 Drawing Sheets

(56) References Cited

U.S. PATENT DOCUMENTS

| | | | | |
|---|---|---|---|---|
| 2005/0211574 | A1* | 9/2005 | Reeve | B65D 85/18 206/8 |
| 2006/0145438 | A1 | 7/2006 | Plummer | |
| 2007/0199833 | A1* | 8/2007 | Hunt, Sr. | A45C 11/02 206/8 |
| 2011/0253559 | A1 | 10/2011 | McDonald | |
| 2017/0127778 | A1 | 5/2017 | Tuning | |
| 2017/0231346 | A1 | 8/2017 | Todmann | |

* cited by examiner

STORAGE DEVICE FOR HATS AND/OR CAPS

BACKGROUND

Technical Field

The embodiments of the present invention disclosed herein relate to storage devices and apparatuses for hats and/or caps that are well suited for organizing the hats and/or caps into space saving arrangements.

Description of the Related Art

Storage devices and apparatuses for storing stacked arrangements of hats and/or caps have been previously proposed in the art. However, the previously known storage devices and apparatuses for storing stacked arrangements of hats and/or caps, lack the advantageous features of the embodiments of the present invention disclosed herein below.

SUMMARY OF THE PRESENT INVENTION

The embodiments of the present invention disclosed herein relate to storage devices for hats and/or caps, such as, but not limited to, baseball caps, ball caps, sports caps or hats, golf caps or hats, and driver or driving caps, that allow for organizing the hats and/or caps into space saving arrangements. The embodiments disclosed herein comprise an outer shell that is formed in part by a movable closure that allows for access to the interior of the shell for the purpose of placing hats and/or caps in the outer shell and/or removing hats and/or caps from the outer shell. In some embodiments herein, the storage device includes means for being hung on a hanging rod or pole that is usually positioned in a closet and/or for being hung on a hanging member, device or apparatus that may be positioned behind a door, on a wall, or in any applicable position or arrangement. In some embodiments herein, the storage device includes means for hanging other similar storage devices, such as, but not limited to, another storage device of the present invention or any applicable storage device or apparatus known to one of ordinary skill in the art, from the storage device of the present invention.

In some embodiments herein, the movable closure is a pivotally movable closure that is supported for pivotal movement between an open position and a closed position. In some embodiments herein, the outer shell is made in two sections that are referred to herein as a first shell and a second shell, respectively. Some embodiments herein may include pivot means for allowing the pivotal movement of the pivotally movable closure. Some embodiments herein may include latch means for selectively securing the pivotally movable closure in the closed position. Some embodiments herein may include limit means for limiting the pivotal movement of the pivotally movable closure so as to limit a size of an opening in the storage device resulting at least in part from the pivotally movable closure being in the open position.

In some embodiments herein, the limit means for limiting the pivotal movement of the pivotally movable closure includes at least one boss. The boss engages the pivotally movable closure, when the pivotally movable closure is in the open position, in order to limit pivotal movement of the pivotally movable closure from the closed position to the open position to a predetermined angle. In some embodiments herein, the predetermined angle is equal to or less than 90 degrees. The limit means for limiting the pivotal movement of the pivotally movable closure prevents the hats and/or caps stored in the storage device from falling out of the storage device due to the excessive opening of the pivotally movable closure when a user attempts to access the interior of the storage device for placing hats and/or caps in or within the outer shell and/or removing hats and/or caps from the outer shell, which is a drawback of previously known hat and/or cap storage devices designed for hanging in a closet that employ a pivotally movable closure. This feature obviates the need for the user to use one hand to control the degree of opening of the pivotally movable closure, while attempting to add hats and/or caps to and/or to remove hats and/or caps from the storage device with the other hand. Thus, this feature leaves both of the user's hands free for placing hats and/or caps in the outer shell and/or removing hats and/or caps from the outer shell.

These and other advantages of the embodiments herein will become further evident upon study of the drawings or figures of this application and the detailed description below.

It should be understood that the drawings or figures of this pending application are not intended to limit the scope of the present invention in any way.

DETAILED DESCRIPTION OF PREFERRED EMBODIMENTS

Figure 1:
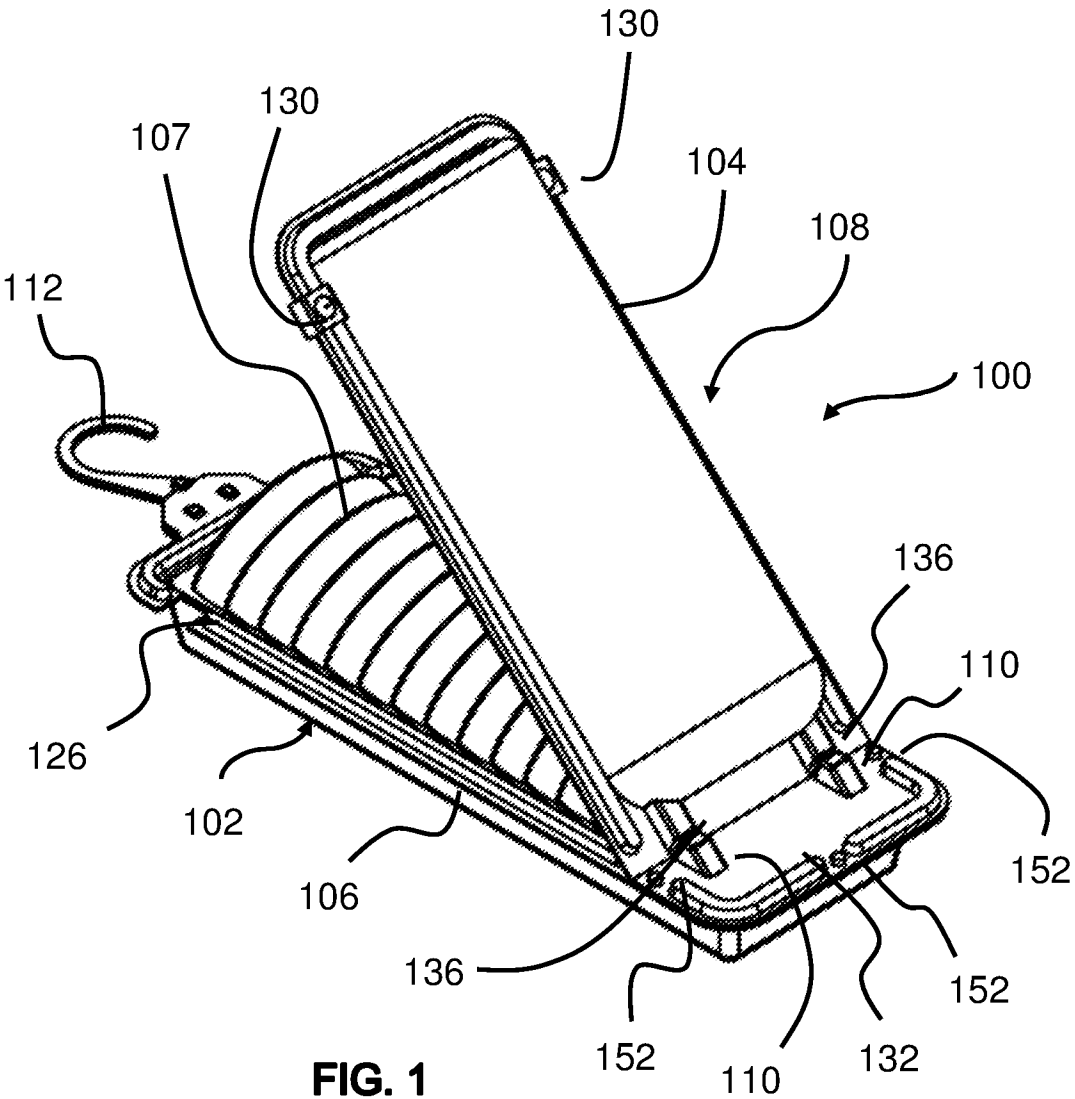
FIGS. 1 and 2 are environmental views of a first illustrative embodiment herein showing the pivotally movable closure in the open position to reveal a shingled array or arrangement of caps contained within the storage device of the present invention.
Figure 2:
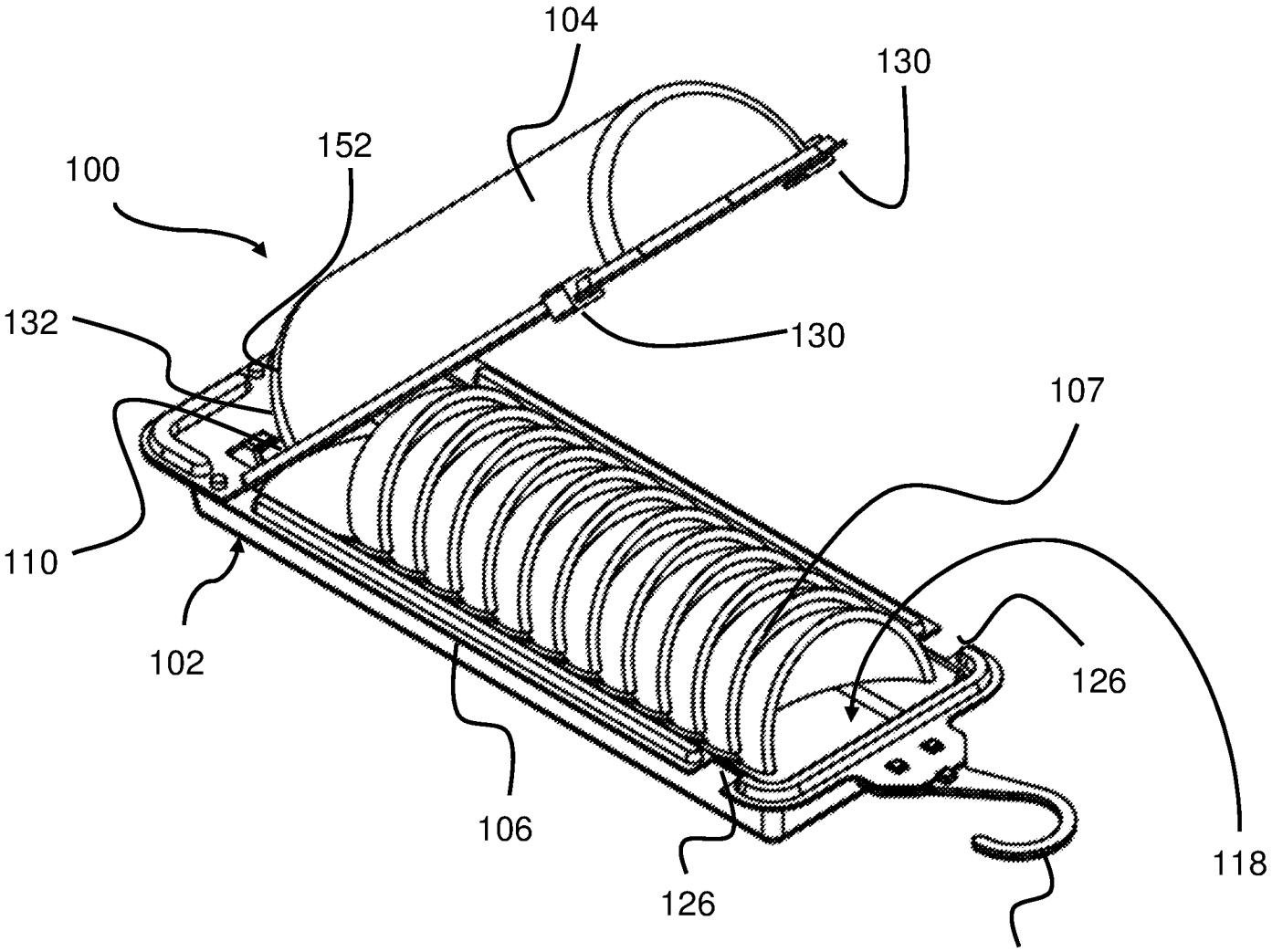
Figure 3:
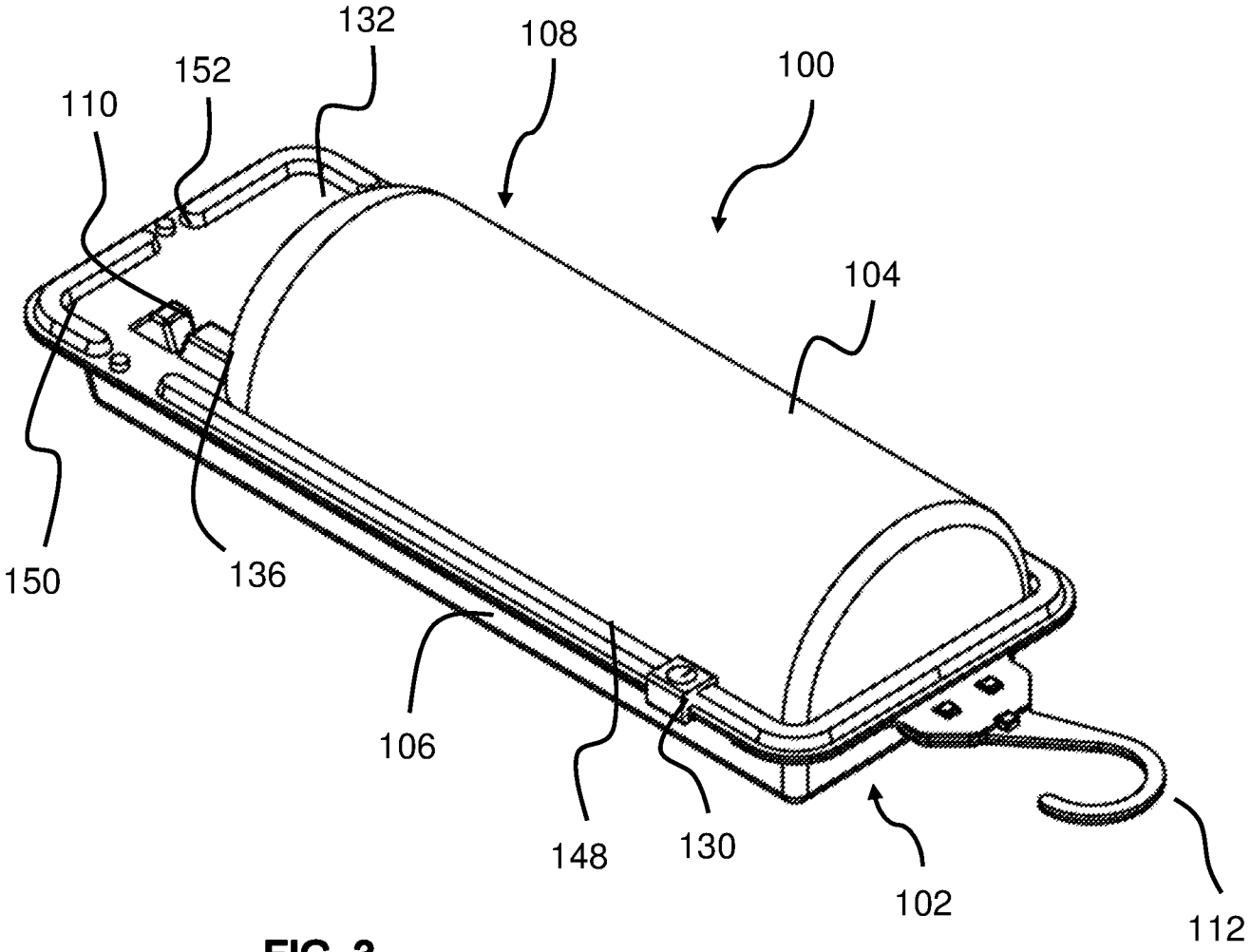
FIGS. 3 and 4 are views of the first illustrative embodiment herein showing the pivotally movable closure in the closed position and showing the latch slides in the latched position.
Figure 4:
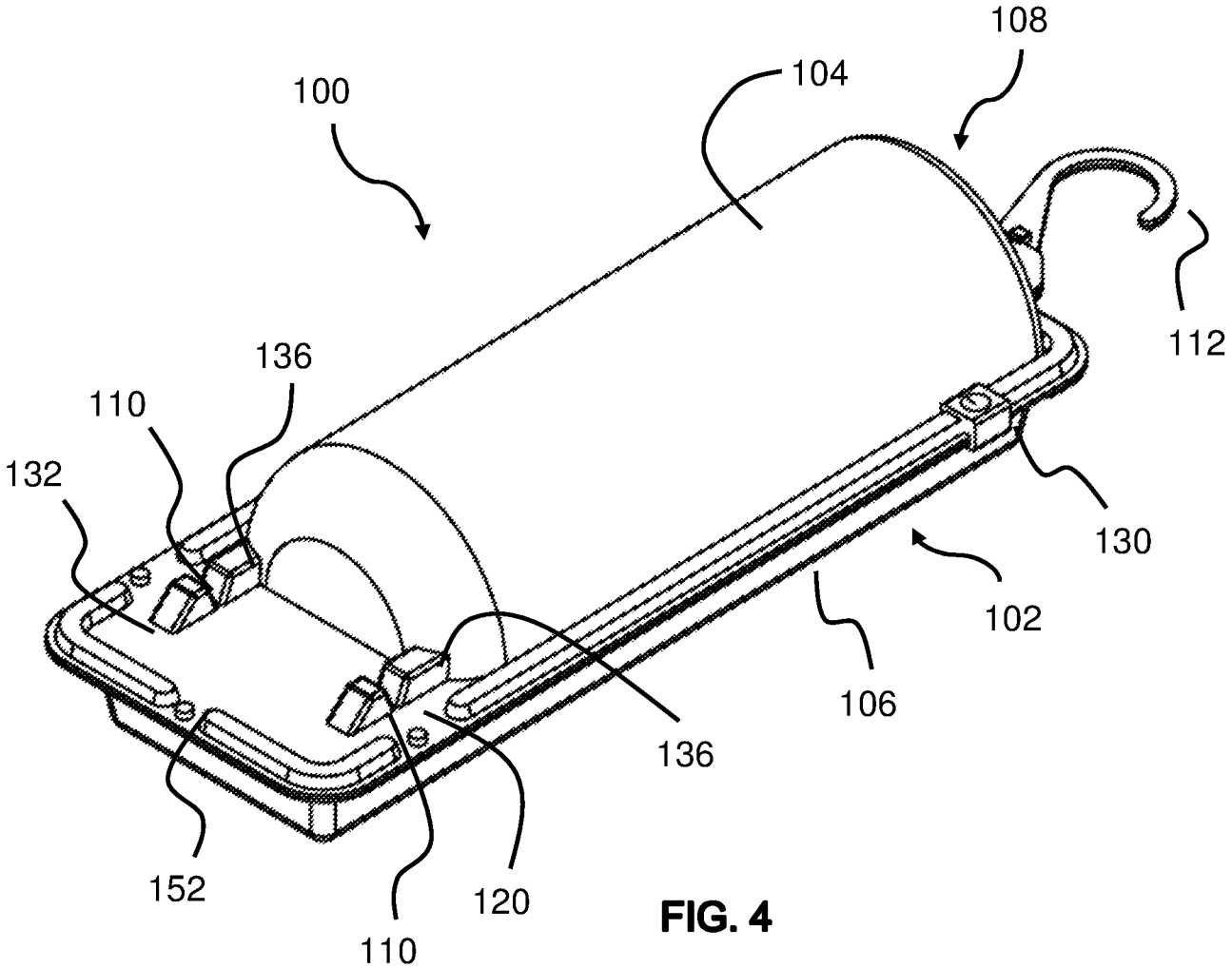
Figure 5:
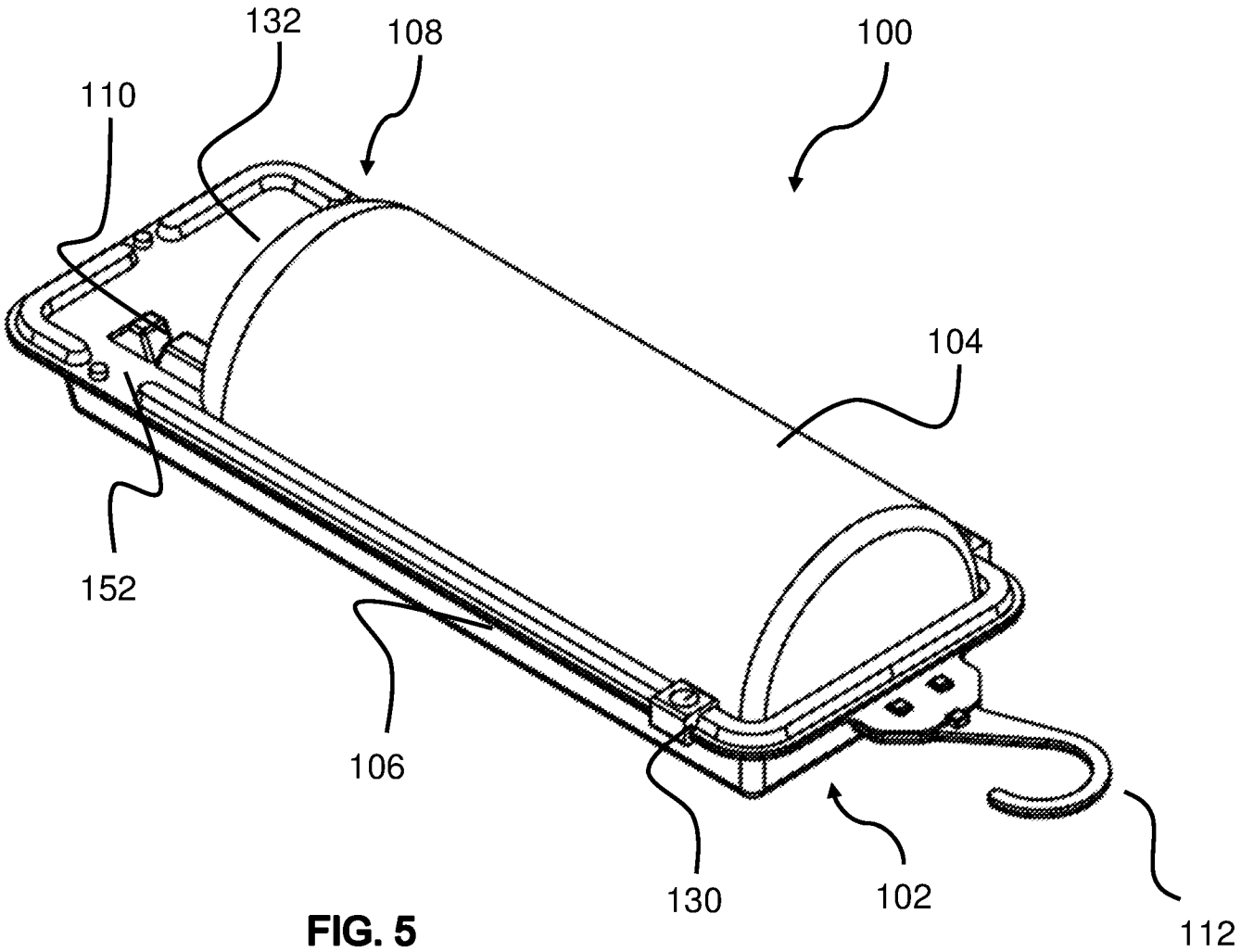
FIGS. 5 and 6 are views of the first illustrative embodiment herein showing the pivotally movable closure in the closed position and showing the latch slides in the unlatched position.
Figure 6:
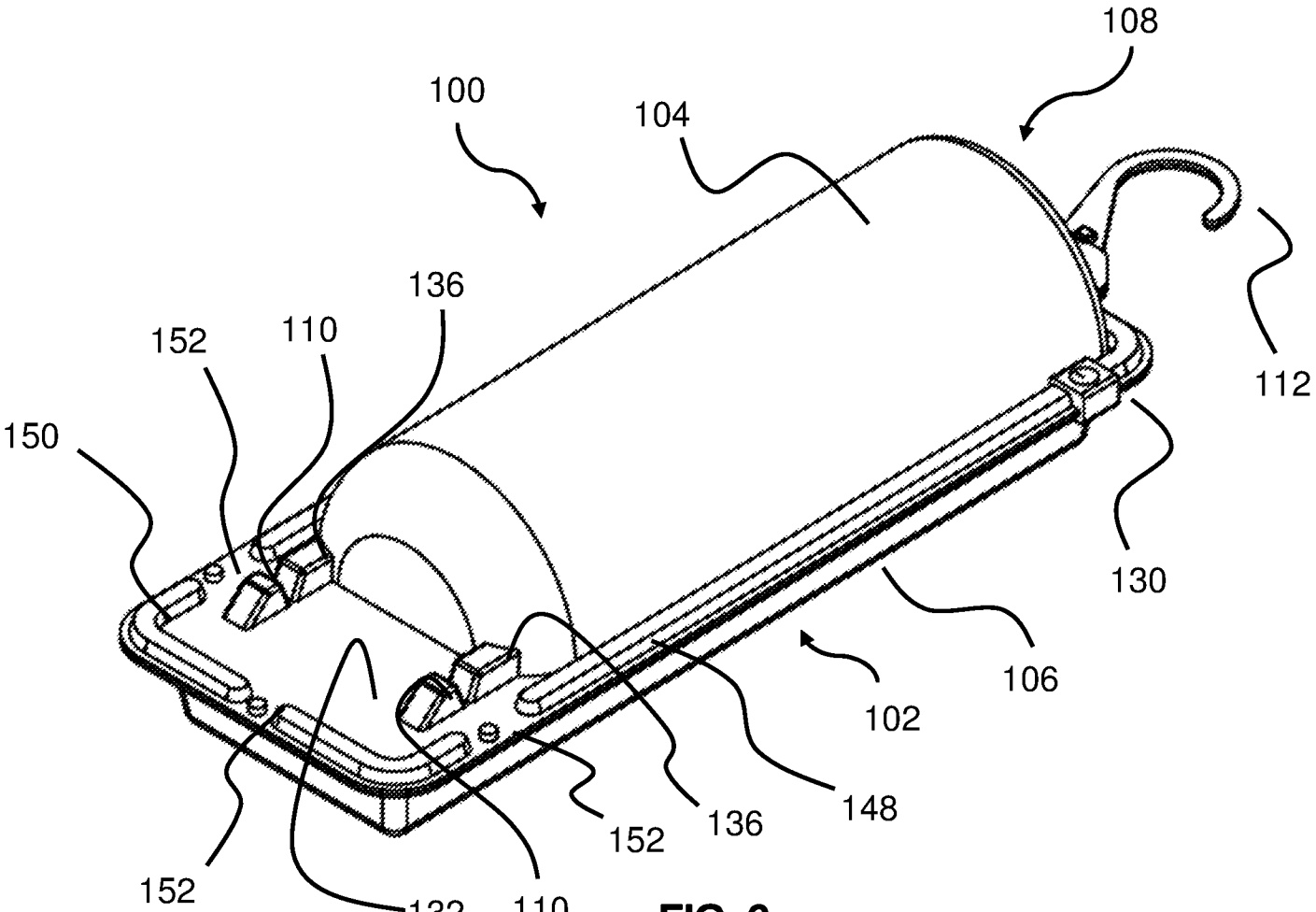
Figure 7:
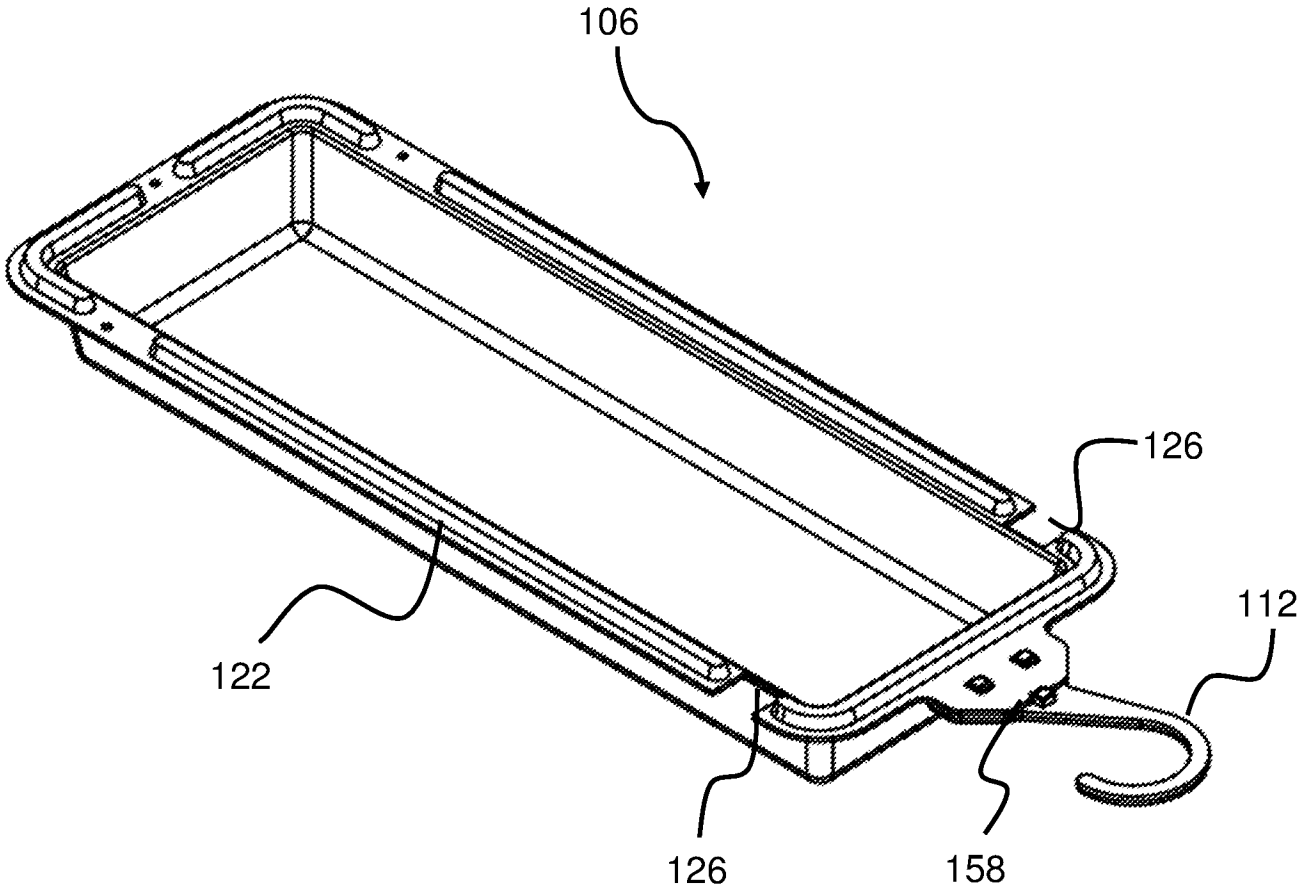
FIGS. 7 and 8 are isometric views of the assembly including the first shell and the hanger hook of the first illustrative embodiment herein.
Figure 8:
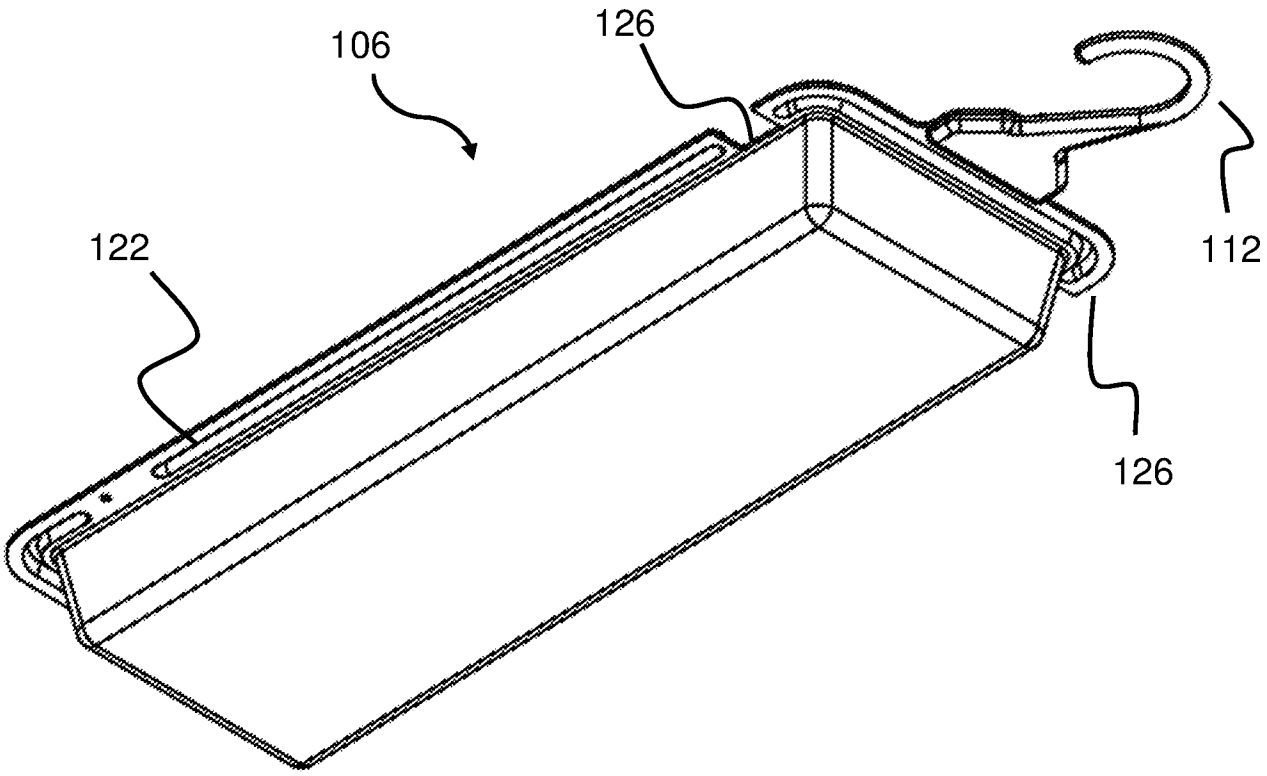
Figure 9:
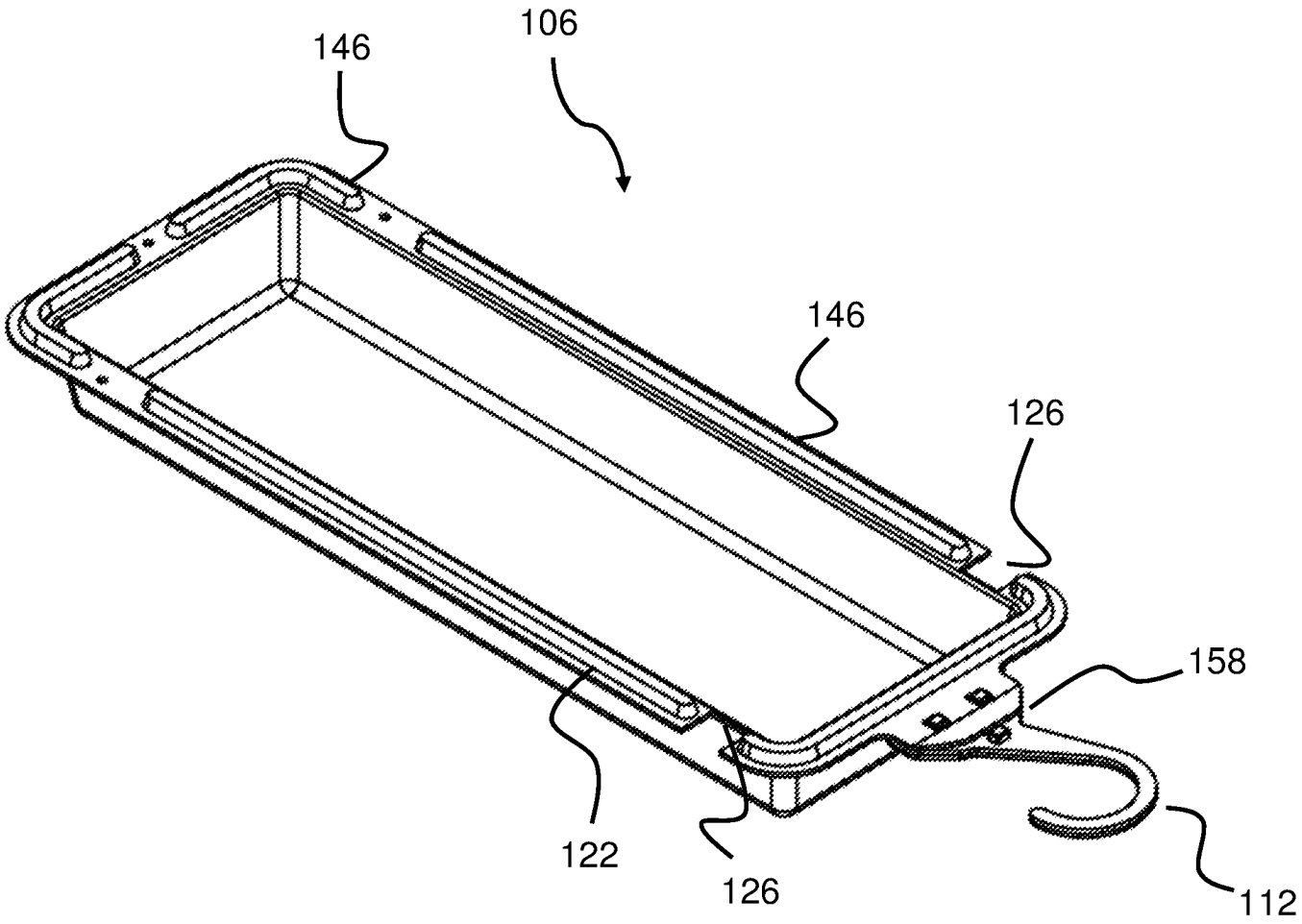
FIG. 9 is an isometric view of the first shell and the hanger hook of the first illustrative embodiment herein during the process of assembly showing the tab for the attachment of the hanger hook just before it is snapped into its final position.
Figure 10:
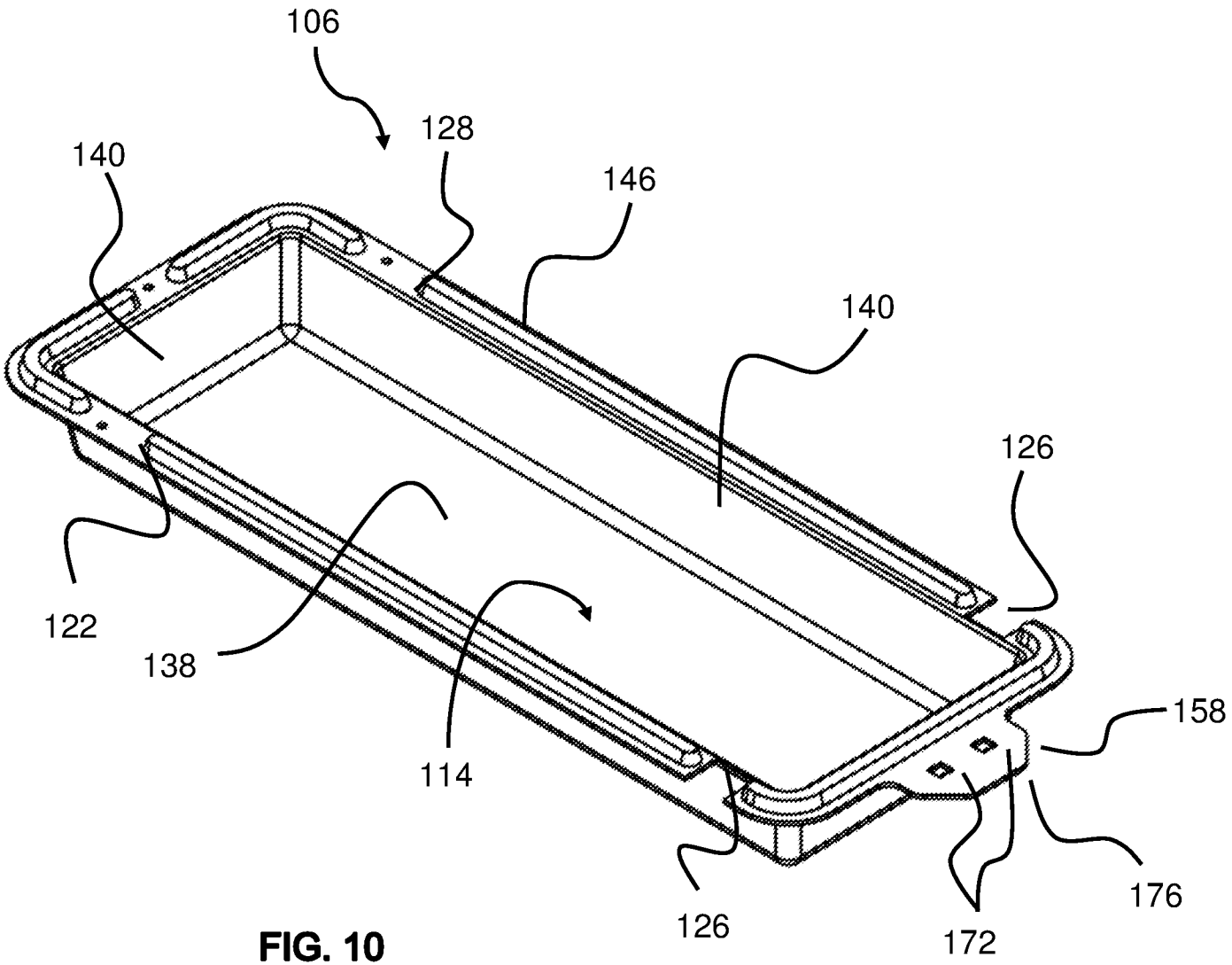
FIGS. 10 and 11 are isometric views of the first shell of the first illustrative embodiment herein.
Figure 11:
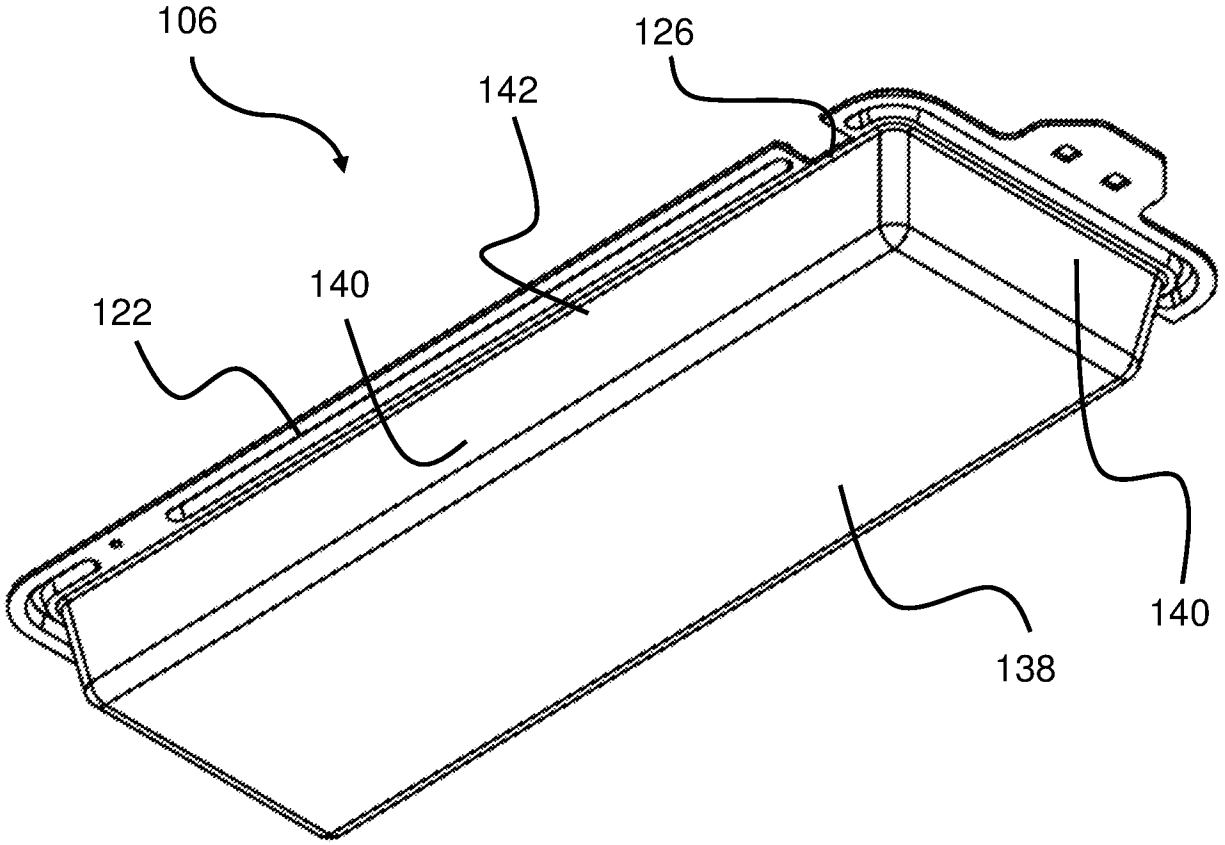
Figure 12:
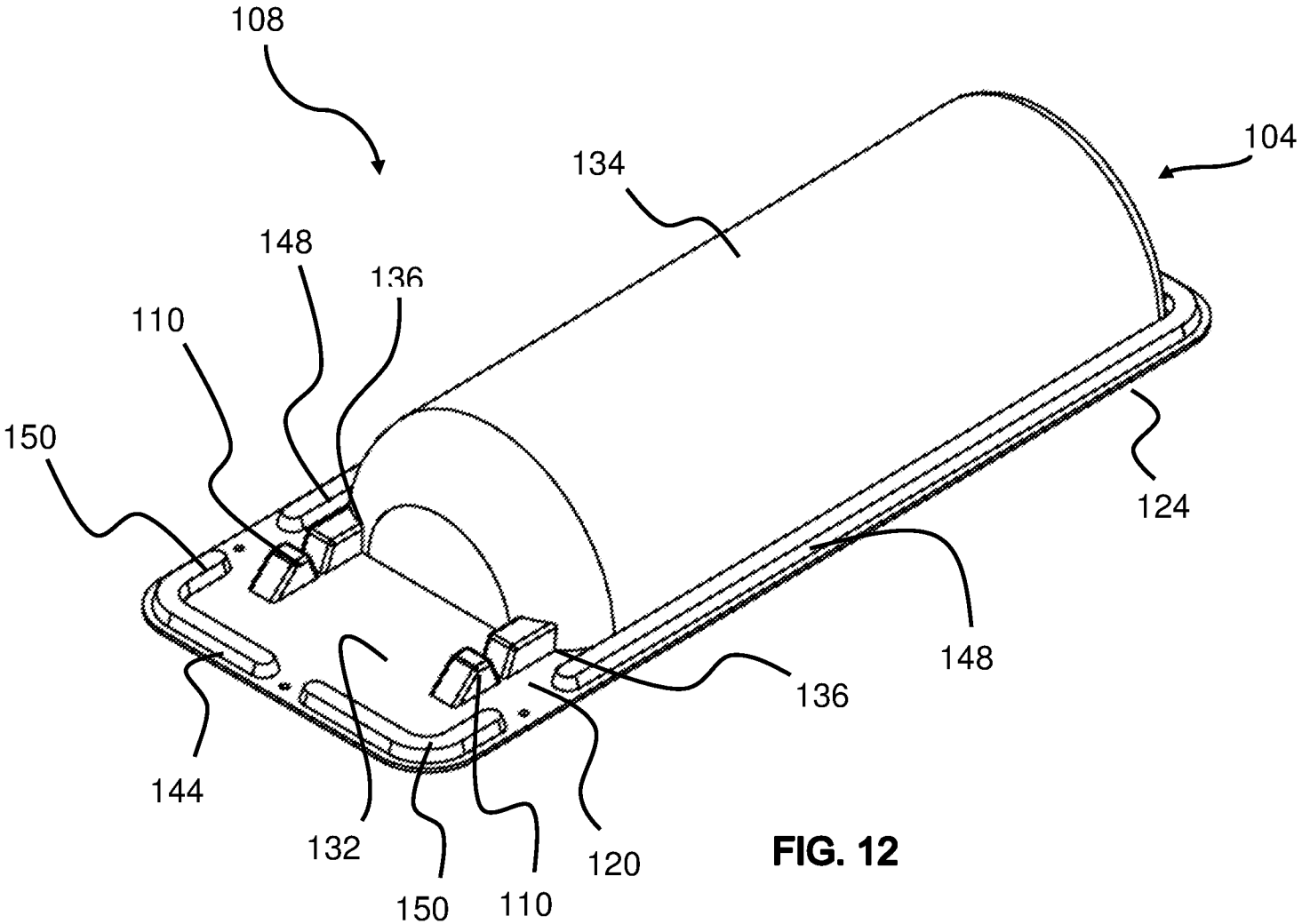
FIGS. 12 and 13 are isometric views of the second shell of the first illustrative embodiment herein showing the pivotally movable closure in the closed position.
Figure 13:
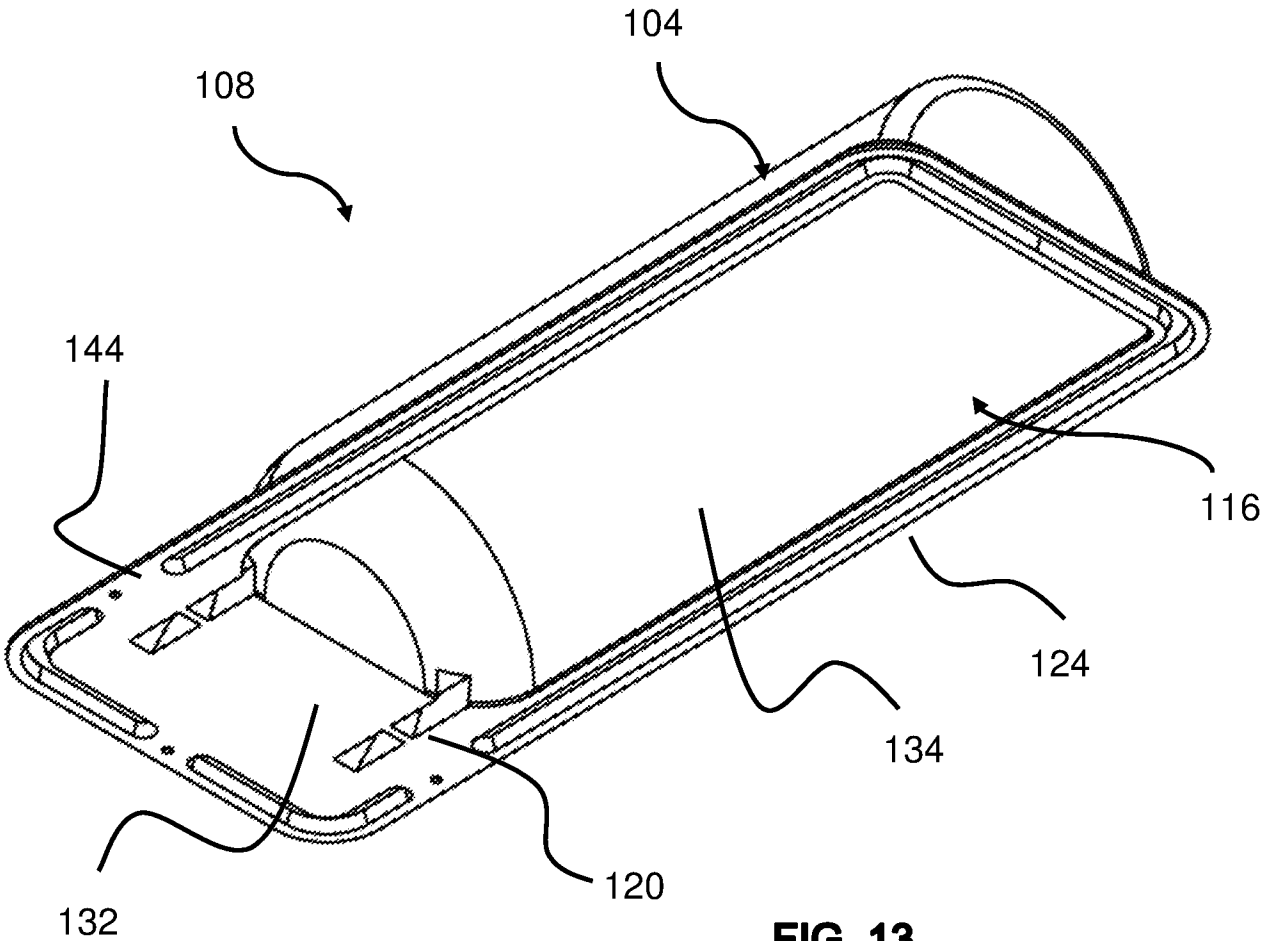
Figure 14:
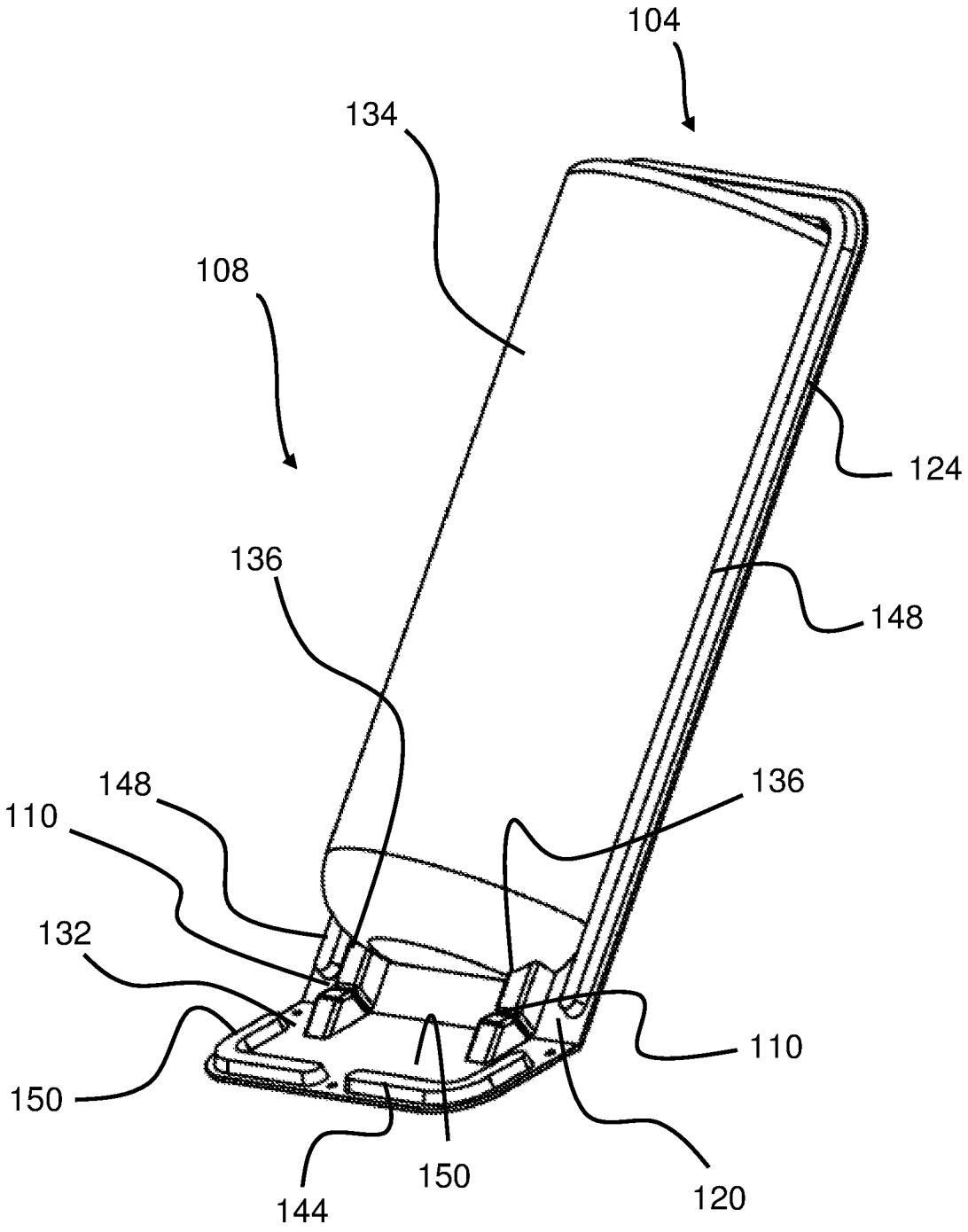
FIGS. 14 and 15 are isometric views of the second shell of the first illustrative embodiment herein showing the pivotally movable closure in the open position.
Figure 15:
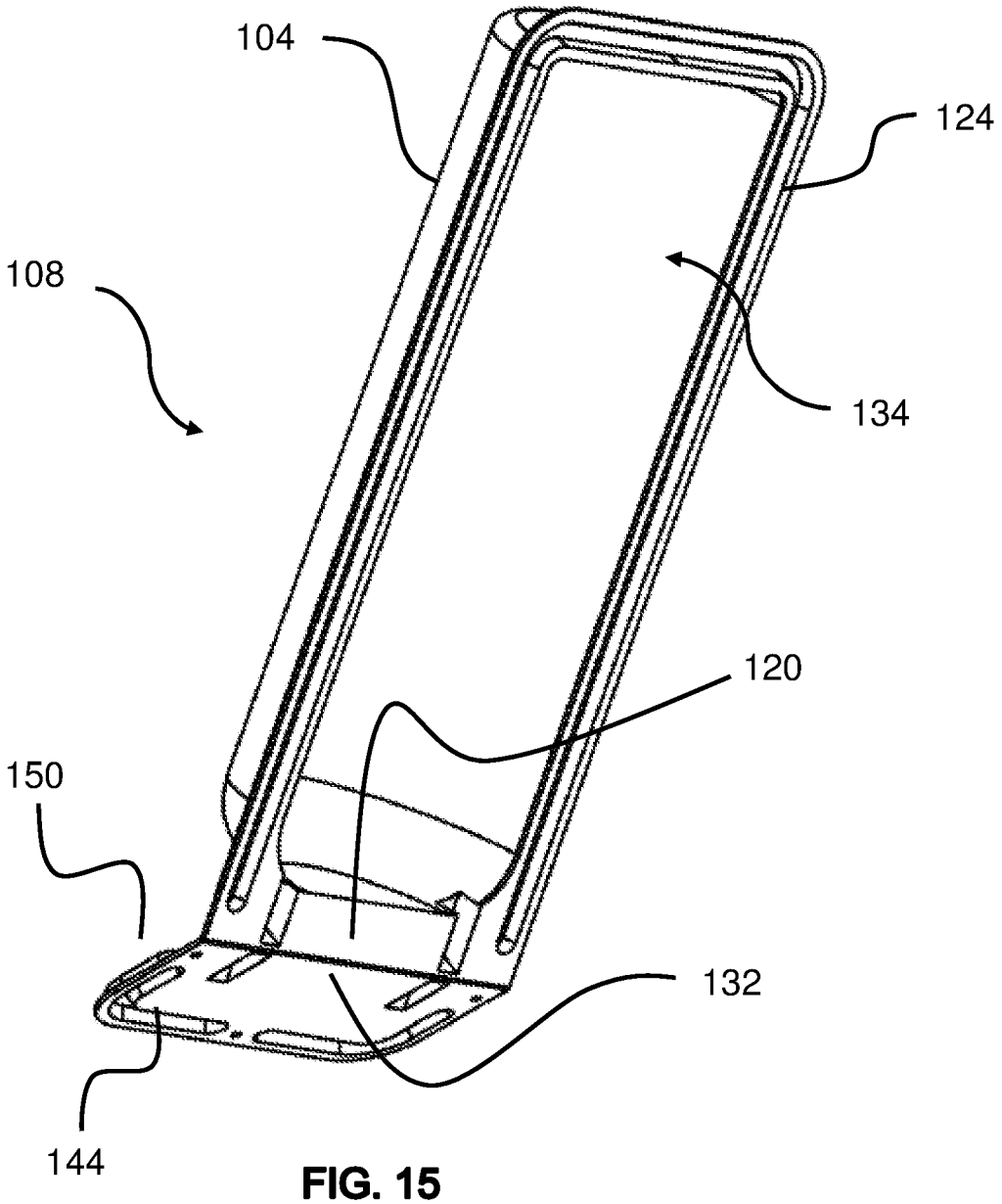
Figure 16:
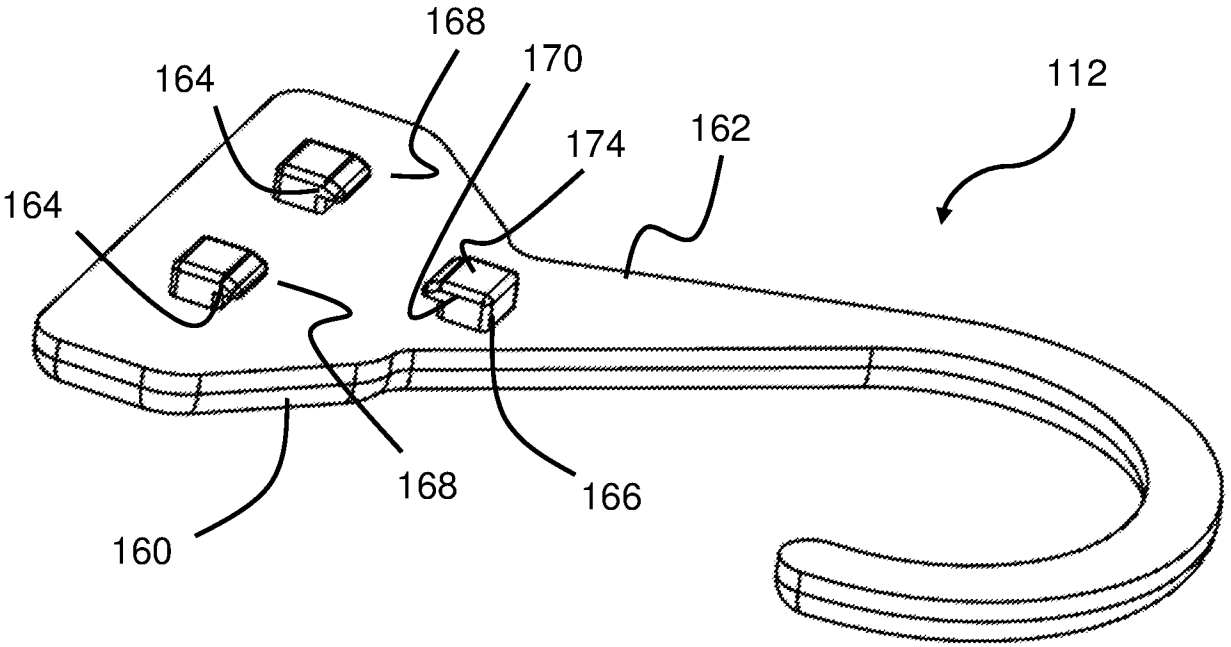
FIG. 16 is an isometric view of the hanger hook of the first illustrative embodiment herein.
Figure 17:
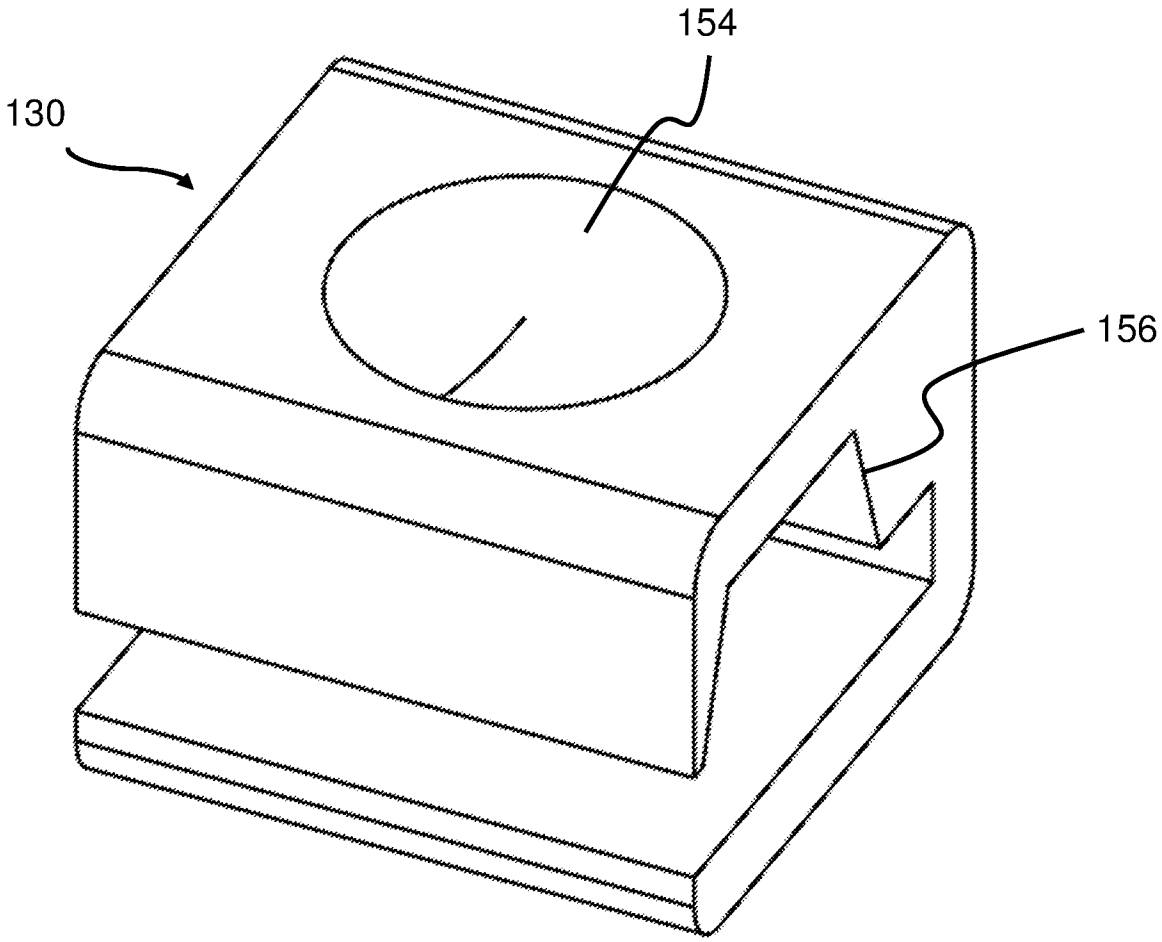
FIG. 17 is an isometric view of the latch slide of the first illustrative embodiment herein.
Figure 18:
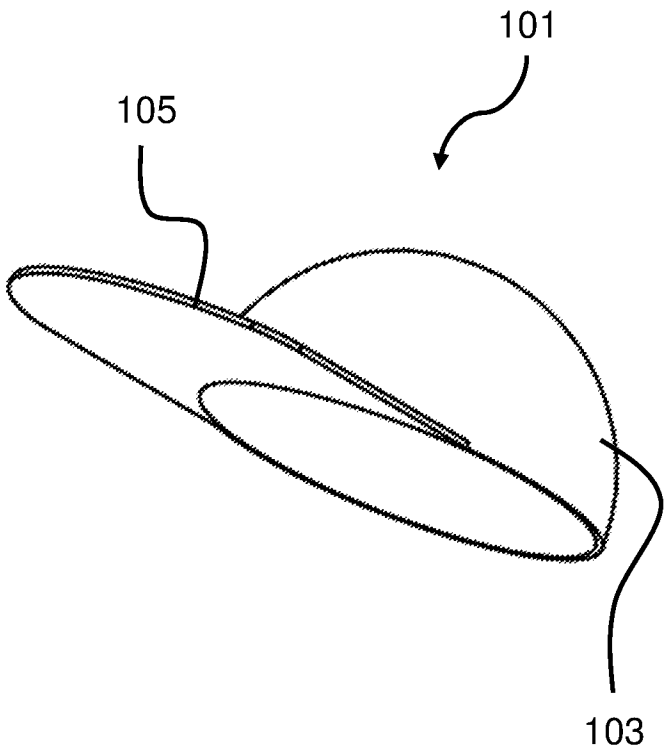
FIG. 18 is an isometric view of a type of cap that can be stored in the storage device according to the first illustrative embodiment herein.
Figure 19:
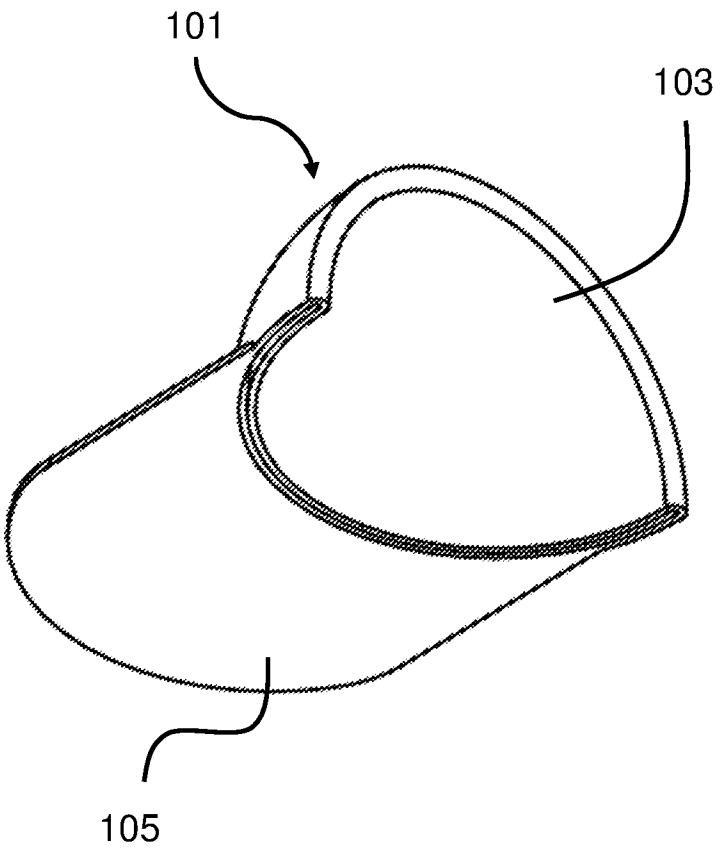
FIG. 19 is an isometric view of the cap of FIG. 18 showing the head-covering portion of the cap in the folded configuration.
Figure 20:
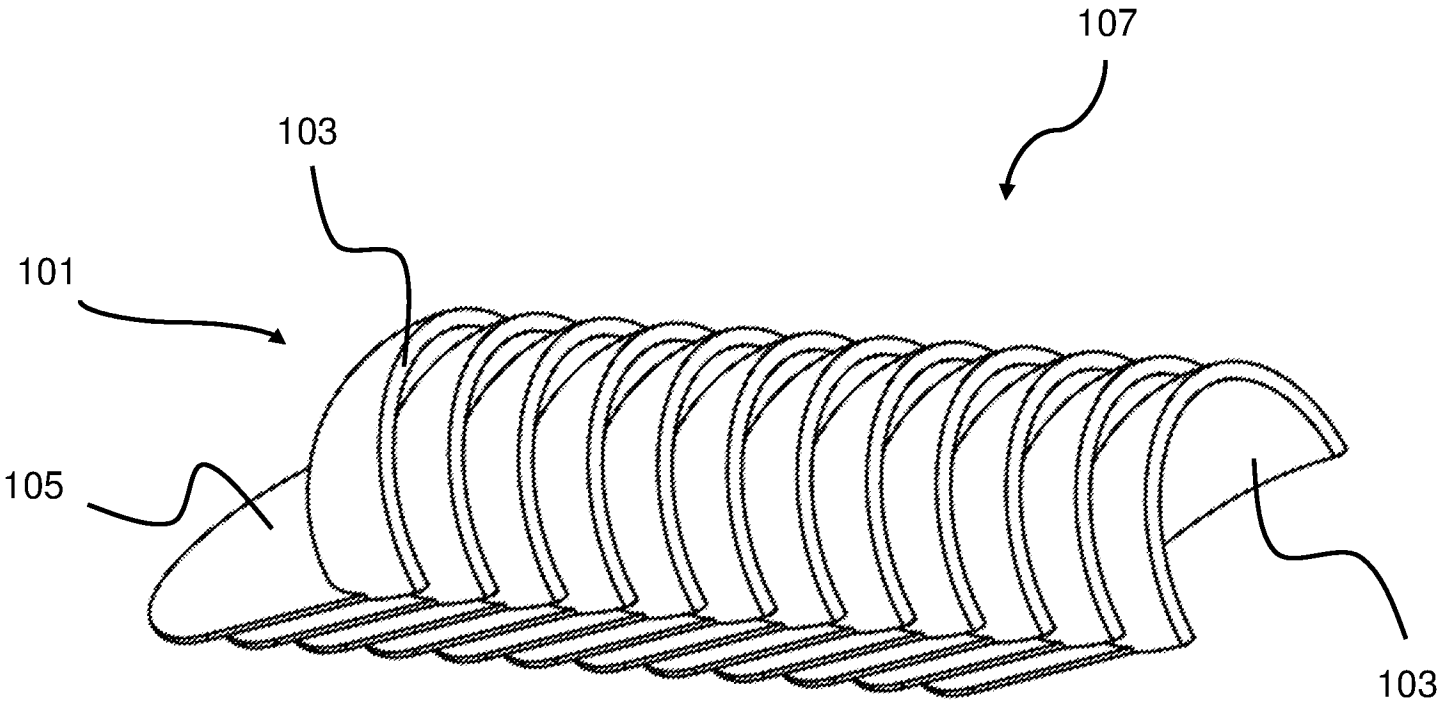
FIG. 20 is a view of a shingled array of a plurality of caps of the type shown in FIG. 18 with the head-covering portions of the caps being in the folded configuration.

Referring to FIGS. 1-20, an illustrative embodiment 100 of the storage device can be seen. The storage device 100 is intended for storing hats and/or caps 101, such as, but not limited to, baseball caps, ball caps, sports caps or hats, golf caps or hats, and driver or driving caps, and allows for organizing the caps 101 into space saving arrangements. As a non-limiting example, each of the caps 101 is of the type having a head-covering portion 103 and a bill 105 that is commonly referred to as a baseball cap. The bill 105 is attached to the front rim of the head-covering portion 103. In the illustrative embodiment, the storage device 100 is adapted for storing one or more of the caps 101 that are stacked in a shingled arrangement 107, as shown in FIG. 20. In the shingled arrangement 107, each cap 101 is in a folded configuration where approximately the rear half of the head-covering portion 103 of the cap 101 is folded or collapsed into roughly the front half of the head-covering portion 103 of the cap such that the rear portion of the head-covering portion 103 lies against, and follows the contour of, the front portion of the head-covering portion 103. When the cap 101 is in the folded configuration illustrated in FIG. 19, the folded head-covering portion 103 of the cap 101 forms roughly a half dome that has a concave inner side and a convex outer side to which the bill 105 of the cap is attached. When caps 101 in the folded condition are stacked such that the bill 105 of each succeeding cap 101 is partially overlapped by the bill 105 of the previous cap and the folded head-covering portion 103 of each succeeding cap 101 is partially received within the concave side of the folded head-covering portion 103 of the previous cap 101, a "shingled" arrangement is formed due to the bills of the caps 101 being stacked with the bill 105 of each succeeding cap 101 being partially overlapped by the bill 105 of the previous cap 101 in a manner resembling shingles on a roof. The shingled arrangement of caps 101 is also described in U.S. Pat. No. 5,022,515, issued to Agostine, on Jun. 11, 1991, which is incorporated by reference herein in its entirety.

The storage device 100 comprises an outer shell 102 that is formed in part by a movable closure 104 that allows for access to the interior of the outer shell 102 for the purpose of placing hats and/or caps in the outer shell 102 or removing hats and/or caps from the outer shell 102. The storage device 100 includes means for hanging the storage device 100 on, for example, the hanging rod or pole that is usually positioned in a closet and/or for being hung on a hanging member, device or apparatus that may be positioned behind a door, on a wall, or in any applicable position or arrangement. The means for hanging the storage device 100 includes any means suitable for that purpose, and includes, but is not limited to, the examples provided below. In the illustrated embodiment, the means for hanging the storage device 100 comprises a hook 112 that is attached to the outer shell 102 and allows the storage device 100 to be hung on the hanging rod or pole that is usually positioned in a closet in the same manner as a clothes hanger. Other examples of means for hanging the storage device 100 include a carabiner and a loop of cord or rope.

In the illustrated embodiment of FIGS. 1-17, the first shell 106 is provided with a hook attachment tab 158 that is attached to the first flange 122 at an end of the first shell 106 that is farthest from the lower shelf portion 132. The hanger hook 112 is provided with a base plate 160 to which the stem 162 of the hanger hook 112 is attached. The base plate 160 is adapted and configured to lie flat against one side of the hook attachment tab 158 and abut that side of the hook attachment tab 158. The base plate 160 is provided with three posts 164 and 166. Each of the posts 164 and 166 has a head in the form of a hook end 168 and 170, respectively, that over hangs the shaft of the respective post on one side and thus forms a corresponding overhang on that side of the respective post. The hook ends 168 of the posts 164 overhang the shafts of the respective posts 164 on the side of the shaft of each respective post 164 that faces toward the side of the base plate 160 to which the stem 162 of the hook portion of the hanger hook 112 is attached. The hook end 170 of the post 166 overhangs the shaft of the posts 166 on the side of the shaft of the post 166 that faces away from the side of the base plate 160 to which the stem 162 of the hook portion of the hanger hook 112 is attached. Accordingly, the overhangs of the hook ends 168 of the posts 164 extend in a direction opposite the direct in which the overhang of the hook end 170 of the post 166 extends. The hook attachment tab 158 has two holes 172 that provide clearance for the heads or hook ends 168 of the posts 164 such that each of the posts 164 can be inserted into a respective one of the holes 172. The distance between the overhang of each post 164 and 166 and the base plate 160 of the hanger hook 112 is sufficient to accommodate the thickness of the hook attachment tab 158 such that a portion of the hook attachment tab 158 can be received between the overhang of each post 164 and 166 and the base plate 160 of the hanger hook 112. Preferably, the top surface 174 of at least the overhang of the post 166 is beveled to ease assembly of the hanger hook 112 to the first shell 106 or the outer shell 102.

To assemble the hanger hook 112 and the first shell 106 or the outer shell 102 together, i.e. attach the hanger hook 112 to the hook attachment tab 158, the posts 164 are first inserted through the holes 172 and the hanger hook 112 is pulled away from the first shell 106 such that a respective portion of the hook attachment tab 158 near an edge of each hole 172 is captured between the overhang of respective post 164 and the base plate 160 of the hanger hook 112. Accordingly, the overhang of each post 164 engages an edge of a respective hole 172. An edge 176 of the hook attachment tab 158, farthest from the attachment of the hook attachment tab 158 to the first flange 122, is then pushed under the overhang of the post 166 such that the overhang of the post 166 engages the edge 176 of the hook attachment tab 158 to secure the hanger hook 112 to the hook attachment tab 158. Accordingly, a portion of the hook attachment tab 158 becomes firmly captured between the posts 164 and the post 166 to securely attach the hanger hook 112 to the hook attachment tab 158. Alternatively, a hole similar to the holes 172 may also be provided for engagement by the post 166.

Figure 21:
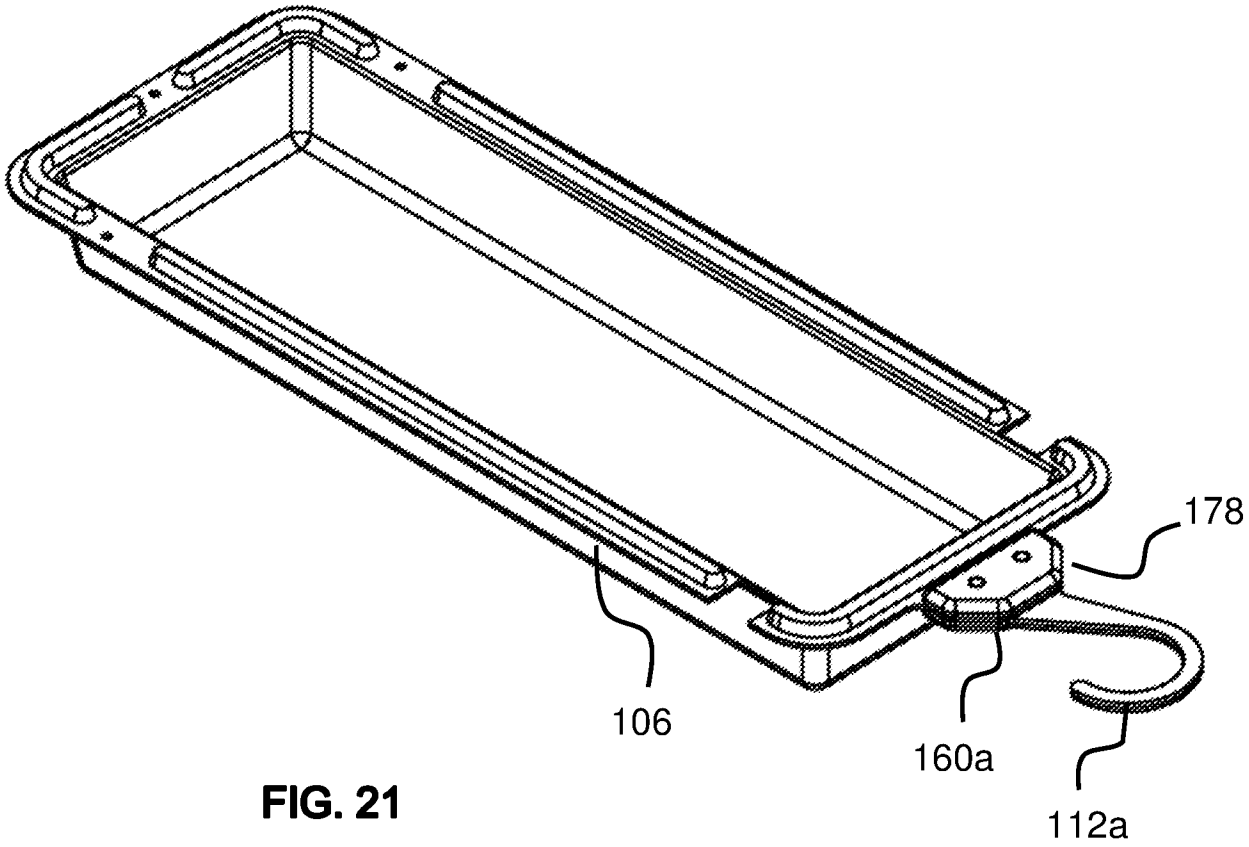
FIG. 21 is an isometric view of the assembly including the first shell and the hanger hook of a second illustrative embodiment herein.
Figure 22:
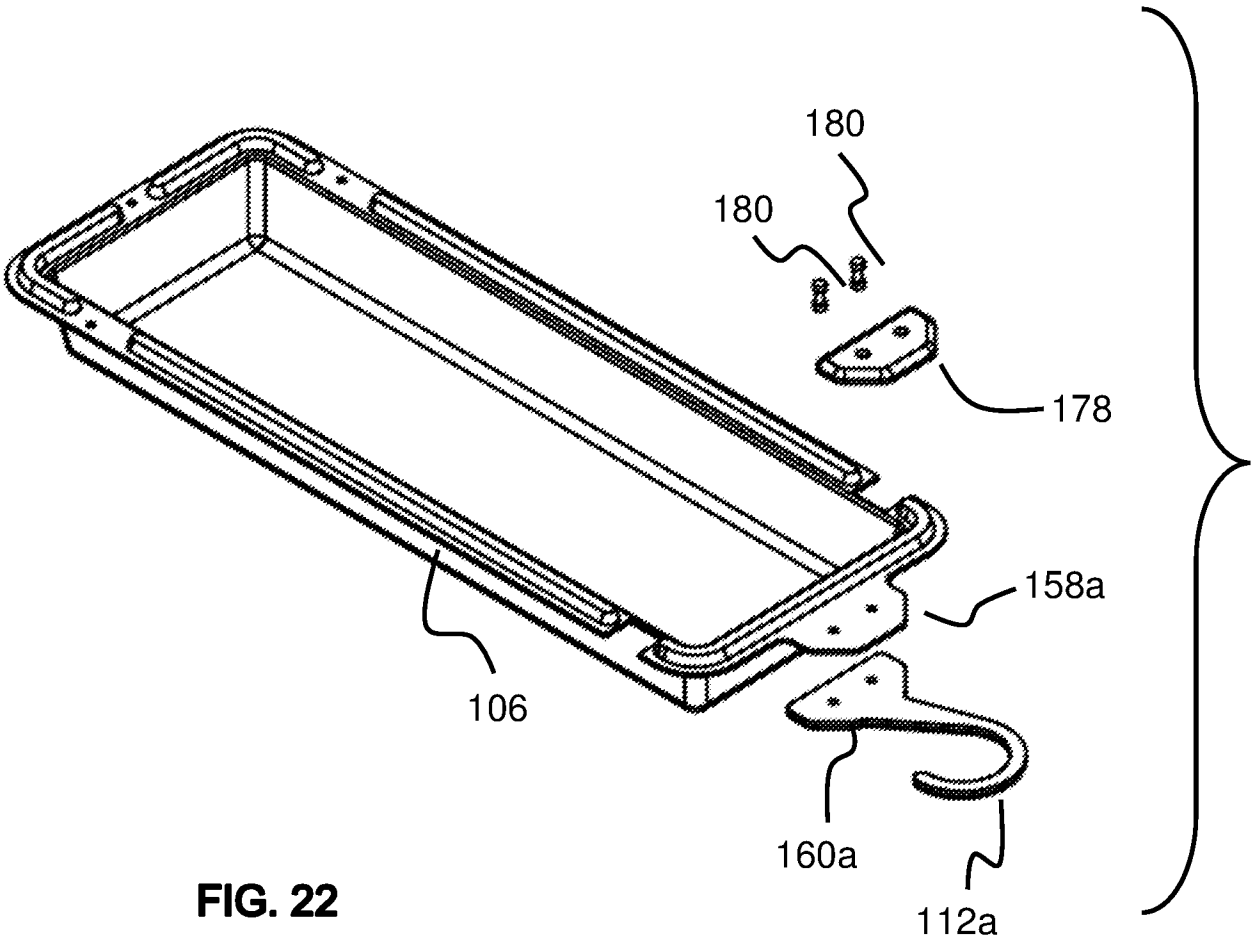
FIG. 22 is an exploded view of the assembly including the first shell and the hanger hook of the second illustrative embodiment herein.

In the illustrated embodiment of FIGS. 21-22, the hanger hook 112*a* lacks the posts 164 and 166. Instead, the hook attachment tab 158*a* is sandwiched or captured between the base plate 160*a* and a reinforcing plate 178. Rivets 180 extend through respective holes in the reinforcing plate 178, the hook attachment tab 158*a*, and the base plate 160*a* to securely attach the hanger hook 112*a* to the hook attachment tab 158*a*.

In the illustrated embodiment, the movable closure 104 is a pivotally movable closure and is supported for pivotal movement between the open position and the closed position. In the illustrative embodiment, the outer shell 102 is made in two sections that are referred to herein as the first shell 106 and the second shell 108, respectively. The illustrative embodiment includes pivot means for allowing the pivotal movement of the pivotally movable closure 104. The illustrative embodiment also includes latch means for selectively securing the pivotally movable closure 104 in the closed position.

The illustrative embodiment further includes limit means for limiting the pivotal movement of the pivotally movable closure 104 so as to limit a size of an opening in the storage device 100 resulting at least in part from the pivotally movable closure 104 being in the open position. The limit means for limiting the pivotal movement of the pivotally movable closure 104 includes any means suitable for that purpose and includes, but is not limited to, the examples provided below. In the illustrated embodiment, the limit means for limiting the pivotal movement of the pivotally movable closure includes at least one boss 110. The boss 110 engages the pivotally movable closure 104, when the pivotally movable closure 104 is in the open position, in order to limit the pivotal movement of the pivotally movable closure 104 from the closed position to the open position to a predetermined angle. In some embodiments herein, the predetermined angle is equal to or less than 90 degrees. In some embodiments herein, the predetermined angle is an acute angle.

An example of an alternative limit means for limiting the pivotal movement of the pivotally movable closure includes a flexible tether attached at one end to the pivotally movable closure and at the other end to a portion of the outer shell 102 that does not move with the pivotally movable closure. Yet another example of an alternative limit means for limiting the pivotal movement of the pivotally movable closure includes a rigid link bar that cooperates with a first pin having an enlarged head provided on the pivotally movable closure and a second pin having an enlarged head provided on a portion of the outer shell 102 that does not move with the pivotally movable closure. Each of the first and second pins would engage a corresponding hole or slot in the link bar such that the link bar would limit the separation between the two pins and in turn limit the angle to which the pivotally movable closure can be opened. In this example, at least one of the first and second pins must engage a slot in the link bar.

The limit means for limiting the pivotal movement of the pivotally movable closure prevents the hats and/or caps 101 stored in the storage device 100 from falling out of the storage device 100 due to the excessive opening of the pivotally movable closure when a user attempts to access the interior of the storage device 100 for placing hats and/or caps 101 in the outer shell and/or removing hats and/or caps 101 from the outer shell, which is a drawback of previously known hats and/or caps storage devices designed for hanging in a closet that employ a pivotally movable closure. This feature obviates the need for the user to use one hand to control the degree of opening of the pivotally movable closure 104, while attempting to add hats and/or caps 101 to and/or remove hats and/or caps 101 from the storage device 100 with the other hand. Thus, this feature leaves both of the user's hands free for placing hats and/or caps 101 in the outer shell 102 and/or removing hats and/or caps 101 from the outer shell 102.

In the illustrated embodiment, the storage device 100 is designed for storing at least one hat or cap 101. More preferably, the storage device 100 is designed for storing a plurality of hats and/or caps 101 stacked in a shingled arrangement or array as described above. The storage device 100 comprises an outer shell 102 formed by a first shell 106 and a second shell 108. The first shell 106 has an open side 114, corresponding to the top side of the first shell 106 in FIGS. 7, 9, and 10. The second shell 108 has an open side 116, corresponding to the bottom side of the second shell 108 in FIG. 13. The storage device 100 is capable of assuming a closed configuration and an open configuration, which correspond to the pivotally movable closure 104 being in the closed position and the pivotally movable closure 104 being in the open position, respectively. In some embodiments, the open configuration of the storage device 100 may correspond to one or more of a plurality of movable closures 104 being in the open position. The first shell 106 and the second shell 108 cooperatively define an enclosed space for storing at least one hat or cap 101 at least when the storage device 100 is in the closed configuration. Preferably, the first shell 106 and the second shell 108 cooperatively form an outer shell 102 and define a corresponding enclosed space that is adapted for housing or storing a plurality of hats and/or caps 101 in a shingled arrangement 107. The storage device 100 has an interior comprising the enclosed space and the interior of the storage device 100 is accessible when the storage device 100 is in the open configuration. The open side of the first shell 106 faces the open side of the second shell 108 at least when the storage device 100 is in the closed configuration. The first shell 106 and the second shell 108 meet at least approximately along the perimeters of the open side of the first shell 106 and the open side of the second shell 108 to form the outer shell 102 and to define the enclosed space of the storage device 100. In the illustrated embodiment, the first shell 106 and the second shell 108 are joined together at least approximately along at least a portion of the perimeters of the open side of the first shell 106 and the open side of the second shell 108.

In the some embodiments, at least one pivotally movable closure 104 is pivotally supported for pivotal movement between the open position and the closed position. In some embodiments, the pivotally movable closure 104 forms at least a portion of at least one of the first shell 106 and the second shell 108 that is pivotally supported for pivotal movement between the open position and the closed position. The pivotally movable closure 104 is in the closed position at least when the storage device 100 is in the closed configuration.

In the illustrated embodiment, the pivotally movable closure 104 is pivotally movable relative to the first shell 106 between an open position and a closed position. The pivotally movable closure 104 forms at least a portion of the second shell 108 and is pivotally supported for pivotal movement relative to the first shell 106 between the open position and the closed position. The second shell 108 and the first shell 106 cooperatively define an enclosed space for storing at least one hat or cap 101 at least when the pivotally movable closure 104 is in the closed position. The storage device 100 has an interior 118 comprising the enclosed space and the interior of the storage device 100 is accessible when the pivotally movable closure 104 is in the open position.

Some embodiments herein include pivot means for allowing the pivotal movement of the pivotally movable closure 104 between the open and closed positions. The pivot means for allowing the pivotal movement of the pivotally movable closure 104 between the open and closed positions includes any means suitable for that purpose and includes, but is not limited to, the examples provided below. In some embodiments, the pivot means comprises a flexible portion 120 of the outer shell 102. The flexible portion 120 is connected to the pivotally movable closure 104. The flexible portion 120 is capable of flexing to allow pivotal movement of the pivotally movable closure 104 between the open position and the closed position.

In some embodiments, the pivot means comprises a flexible portion 120 of at least one of the first shell 106 and the second shell 108. The flexible portion 120 is connected to the pivotally movable closure 104. The flexible portion 120 is capable of flexing to allow pivotal movement of the pivotally movable closure 104 between the open position and the closed position. In the illustrated embodiment, the pivot means comprises a flexible portion 120 of the second shell 108. The flexible portion 120 is connected to the pivotally movable closure 104. The flexible portion 120 is provided intermediate the pivotally movable closure 104 and the boss 110.

An example of an alternative pivot means includes a flexible strip attached at one end to the pivotally movable closure 104 and at the other end to a portion of the outer shell 102 that does not move with the pivotally movable closure. Yet another example of an alternative pivot means includes a hinge comprising a first hinge leaf, a second hinge leaf, and a hinge pin. The first hinge leaf would be provided on the pivotally movable closure 104 and the second hinge leaf would be provided on a portion of the outer shell 102 that does not move with the pivotally movable closure 104. Each of the first and second hinge leaves would have at least one knuckle with a cylindrical bore, and the bores of the knuckles would be in alignment with the pin extending through the bores to pivotally attach the pivotally movable closure 104 to the outer shell 102. The pivot means of the illustrative embodiment 100 can be considered a type of living hinge. Living hinges in general may also be suitable pivot means for use in the embodiments herein.

Some embodiments herein include latch means for selectively securing the pivotally movable closure 104 in the closed position. The latch means may be any means suitable for that purpose and includes, but is not limited to, the examples provided herein. Some embodiments herein include flanges that extend along at least a portion of the perimeter of the pivotally movable closure 104 and along at least a portion of an edge 128 of the outer shell 102 such that the flange 124 of the pivotally movable closure 104 abuts the flange 122 of the outer shell 102 when the pivotally movable closure 104 is in the closed position. The edge 128 of the outer shell 102 is coextensive with at least a portion of the perimeter of the pivotally movable closure 104.

In embodiments where the outer shell 102 is formed by a first shell 106 and a second shell 108, the first flange 122 extends along at least a portion of a perimeter or edge of at least a portion of one of the first shell 106 and the second shell 108 that is not formed by the pivotally movable closure 104, and the second flange 124 extends along at least a portion of the perimeter of the pivotally movable closure 104. In the illustrated embodiment, the first flange 122 extends along at least a portion of a perimeter of the open side 114 of the first shell 106, and the second flange 124 extends along at least a portion of the perimeter or edge of the pivotally movable closure 104.

One of the first flange 122 and the second flange 124 has a cutout 126. A slide 130 is supported for rectilinear movement between a latched position and an unlatched position on one of the first flange 122 and the second flange 124 that does not have the cutout 126. The slide 130 captures portions of both the first flange 122 and the second flange 124 to keep the pivotally movable closure 104 in the closed position when the slide 130 is in the latched position. The slide 130 registers with the cutout 126 so as to allow movement of the pivotally movable closure 104 to the open position when the slide 130 is in the unlatched position. In this example, the latch means comprises the cutout 126, the slide 130, and portions of the first flange 122 and the second flange 124 that define the cutout 126 and are within a range covered by the slide 130 in the latched position and the unlatched position and as the slide 130 moves between the latched position and the unlatched position when the pivotally movable closure 104 is in the closed position.

In the illustrated embodiment, the first flange 122 has a cutout 126. The slide 130 is supported for rectilinear movement between a latched position and an unlatched position on the second flange 124. An example of an alternative suitable latch means includes pivoting hook latches that are spring biased to the latched position and snap over one or the other of the first flange 122 and the second flange 124, which is also referred to as a slam latch. Other suitable latch means include, without limitation, quarter turn latches, draw latches, snaps, cam latches, latch bolts, hook and eye latches, swell laches, pawl latches, bayonet latches, and magnetic catches.

The exterior surfaces of the slide 130 may be provided with one or more finger depressions 154, as shown, or with serrations, ribbing, knurling, stippling, a combination of these, or the like to afford a better grip for the user or person operating the slide 130. At least one inner surface of the slide 130 may be provided with a groove 156 that receives or is engaged by the ribs 148 of the second flange 124. This arrangement allows the slide 130 to be more accurately guided in its rectilinear motion and prevents the slide 130 from being inadvertently pulled away from or off the second flange 124.

Some embodiments herein include limit means for limiting the pivotal movement of the pivotally movable closure 104 so as to limit a size of an opening in the storage device 100 resulting at least in part from the pivotally movable closure 104 being in the open position. The limit means for limiting the pivotal movement of the pivotally movable closure 104 may be any means suitable for that purpose and includes, but is not limited to, the examples provided herein, some of which have already been discussed above. In some embodiments, the limit means comprises at least one boss 110 attached to a portion of the outer shell 102 that does not move with the pivotally movable closure 104. The boss 110 engages the pivotally movable closure 104 when the pivotally movable closure 104 is in the open position in order to limit the pivotal movement of the pivotally movable closure 104 from the closed position to the open position to a predetermined angle. In some embodiments, the predetermined angle is equal to or less than about 90 degrees. In some embodiments, the predetermined angle is an acute angle. In some embodiments, the predetermined angle is equal to or less than about 60 degrees. In some embodiments, the predetermined angle is equal to or less than about 45 degrees. In some embodiments, the predetermined angle is equal to or less than about 30 degrees.

In the illustrated embodiment, the limit means comprises at least one boss 110 provided on the second shell 108. The boss 110 is provided on the portion of the second shell 108 that does not move with the pivotally movable closure 104. Accordingly, the boss 110 is provided on the portion of the second shell 108 that is not formed by the pivotally movable closure 104. More specifically, the boss 110 is provided on the lower shelf portion 132 of the second shell 108. Preferably, a pair of bosses 110 are provided in a spaced apart relationship on the lower shelf portion 132 of the second shell 108 and symmetrically arranged on either side of the lengthwise midline of the second shell 108 such that the forces limiting the opening of the pivotally movable closure 104 act in a symmetric manner on the pivotally movable closure 104 to prevent the pivotally movable closure 104 from being cocked, twisted or skewed when it reaches the limit of its opening. Each boss 110 engages the pivotally movable closure 104 when the pivotally movable closure 104 is in the open position in order to limit pivotal movement of the pivotally movable closure 104 from the closed position to the open position to a predetermined angle.

The bosses 110 are preferably molded into the second shell 108. In some embodiments, the bosses 110 may have an approximately triangular or approximately trapezoidal cross section. In some embodiments, the bosses 110 may be a hollow shell of the same thickness as the rest of the second shell 108 and be molded in one piece with the rest of the second shell 108 to save materials and ease manufacturing. The pivotally movable closure 104 may have corresponding bosses 136 that present suitable surfaces for engagement by surfaces on the corresponding bosses 110 to limit the pivotal movement of the pivotally movable closure 104 from the closed position to the open position. The angles through which the contact surfaces of the bosses 136 move in order to make contact with the contact surfaces of the corresponding bosses 110 define, at least approximately, the range of pivotal motion of the pivotally movable closure 104 between the closed position and the open position.

As a non-limiting example, the cap 101 includes a head-covering portion 103 and a bill 105 as previously described herein. At least one of the first shell 106 and the second shell 108 comprises a bulged portion 134 such that the enclosed space defined by the outer shell 102 has at least a portion that is at least sufficiently large to accommodate at least the folded head-covering portion 103 of the cap 101. More preferably, the storage device 100 is capable of storing a plurality of caps 101 stacked in a shingled arrangement 107 as previously described herein. As previously described herein, each of the plurality of caps 101 includes a head-covering portion 103 and a bill 105 and when the plurality of caps 101 are stacked in the shingled arrangement 107 their head-covering portions are in the folded configuration with the folded head-covering portion of each cap 101, other than the first cap 101 in the stack, being nested in the folded head-covering portion of the previous cap 101 in the stack. In some embodiments herein, at least one of the first shell 106 and the second shell 108 comprises a bulged portion 134 such that the enclosed space defined by the outer shell 102 has at least a portion that is at least sufficiently large to accommodate the folded head-covering portions of the plurality of caps 101 stacked in the shingled arrangement 107.

In the illustrated embodiment, the storage device 100 is capable of storing at least one hat or cap 101, and preferably a plurality of hats and/or caps 101, and includes the first shell 106 and the second shell 108. The second shell 108 has a bulged portion 134 and a lower shelf portion 132 connected to one end portion of the bulged portion 134. The storage device 100 is capable of assuming a closed configuration and an open configuration. The second shell 108 has an open side that faces the open side of the first shell 106 at least when the storage device 100 is in the closed configuration. The first shell 106 acts a closure for the open side of the second shell 108. The first shell 106 and the second shell 108 cooperatively form the outer shell 102. The bulged portion 134 of the second shell 108 is formed at least in part by the pivotally movable closure 104. In the illustrated embodiment, the bulged portion 134 of the second shell 108 is formed by the pivotally movable closure 104.

The interior space of the outer shell 102 has an enlarged portion corresponding to the location of the bulged portion 134 and a smaller portion corresponding to the location of the lower shelf portion 132. In some embodiments, the bulged portion 134 may be approximately dome shaped or half-dome shaped. In the illustrated embodiment, the bulged portion 134 is the form of an elongated arched or semi-cylindrical shell that is closed off at the ends to form a vault-like cap or cover structure. The front end of the bulged portion 134 that is closest to the lower shelf portion 132 may be somewhat rounded to loosely follow the convex front side of the folded head-covering portion of the first cap 101 in the shingled arrangement of caps 107, and the rear end of the bulged portion 134 that is farthest from the lower shelf portion 132 may be relatively more flattened or truncated to loosely conform to or follow the rear side of the folded head-covering portion of the last cap 101 in the shingled arrangement of caps 107. The enlarged portion of the interior space of the outer shell 102 is adapted, dimensioned, and configured to receive at least the folded head-covering portions of the plurality of caps 101 in the shingled arrangement or stack 107. The smaller portion of the interior space of the outer shell 102 is adapted, dimensioned, and configured to receive at least a major portion of the bill of the first cap 101, which has the foremost projecting bill, in the shingled stack 107.

In the illustrative embodiment, the second shell 106 is in the form of a pan with an elongated bottom 138 and surrounding sidewall 140. The top edge or perimeter 142 of the sidewall 140, which is the edge of the sidewall 140 located farthest from the bottom 138, defines open side of the first shell 106 that faces the open side of the second shell 108. The first flange 122 preferably extends along the perimeter 142 of the first shell 106 except possibly for the cutout 126. The flange 122 will either be completely cut away over a predetermined length corresponding to the length of the cutout 126 or be cut away for at least a portion of its width over the predetermined length corresponding to the length of the cutout 126.

The second shell 108 may include a third flange 144 that extends over at least a portion of the perimeter of the lower shelf portion 132 of the second shell 108, excluding the portion of the perimeter of the lower shelf portion 132 that is immediately attached to the pivot means. In some embodiments, the third flange 144 is continuous with the second flange 124. In some embodiments, the third flange 144, the second flange 124, and the first flange 122 may be provided with one or more third projecting ribs 150, one or more second projecting ribs 148, and one or more first projecting ribs 146, respectively, to give the structure of the outer shell 102 added rigidity. The ribs 150 and 148 are absent from portions of the third flange 144 and/or the second flange 124 so as not to interfere with the flexing of the flexible portion 120. The ribs 146, 148, and 150 may have cross sections resembling approximately rectangular or approximately trapezoidal channels, or the ribs may be solid throughout.

The illustrated embodiment also includes the pivot means, the latch means, and the limit means as have already been described herein. In the illustrated embodiment, the third flange 144 and the first flange 122 abut one another and are securely and fixedly attached to one another using one or more fasteners 152 to assemble the first shell 106 and the second shell 108 into the outer shell 102. Preferably, at least three fasteners 152 are used to attach the third flange 144 and the first flange 122 together. The fasteners 152 may be, for example, screw and nut sets, screws that thread into the flange or a threaded insert in the flange, rivets, or any combination of these. Alternatively, the third flange 144 and the first flange 122 may be attached together using welding or adhesives.

Preferably, the outer shell 102, the first shell 106, and the second shell 108 are made of a clear or transparent plastic with sufficient rigidity for the shells to maintain their shape and protect the hats and/or caps 101 stored in the storage device 100 while having sufficient flexibility to allow for the flexible portion 120 to flex to provide for the pivotal movement of the pivotally movable closure 104. Non-limiting examples of suitable plastics include polyethylene terephthalate (PET), polypropylene (PP), and polyvinyl chloride (PVC). In a non-limiting example, the outer shell 102, the first shell 106, and the second shell 108 are made of PET of approximately 0.030 inch thickness, and the storage device 100 (excluding the hook 112,112*b*) has an approximate length of 22.5 in, approximate height of 7.0 in, and approximate width of 10.0 in.

In some embodiments, the bulged portion 134 is part of the second shell 108 and is adapted to ensure that the enclosed space defined by the outer shell 102 has at least a portion that is at least sufficiently large to accommodate the folded head-covering portion of the cap 101. In the illustrated embodiment, the bulged portion 134 is part of the second shell 108 and is adapted to ensure that the enclosed space has at least a portion that is at least sufficiently large to accommodate the folded head-covering portions of the plurality of caps 101 stacked in the shingled arrangement 107.

Figure 23:
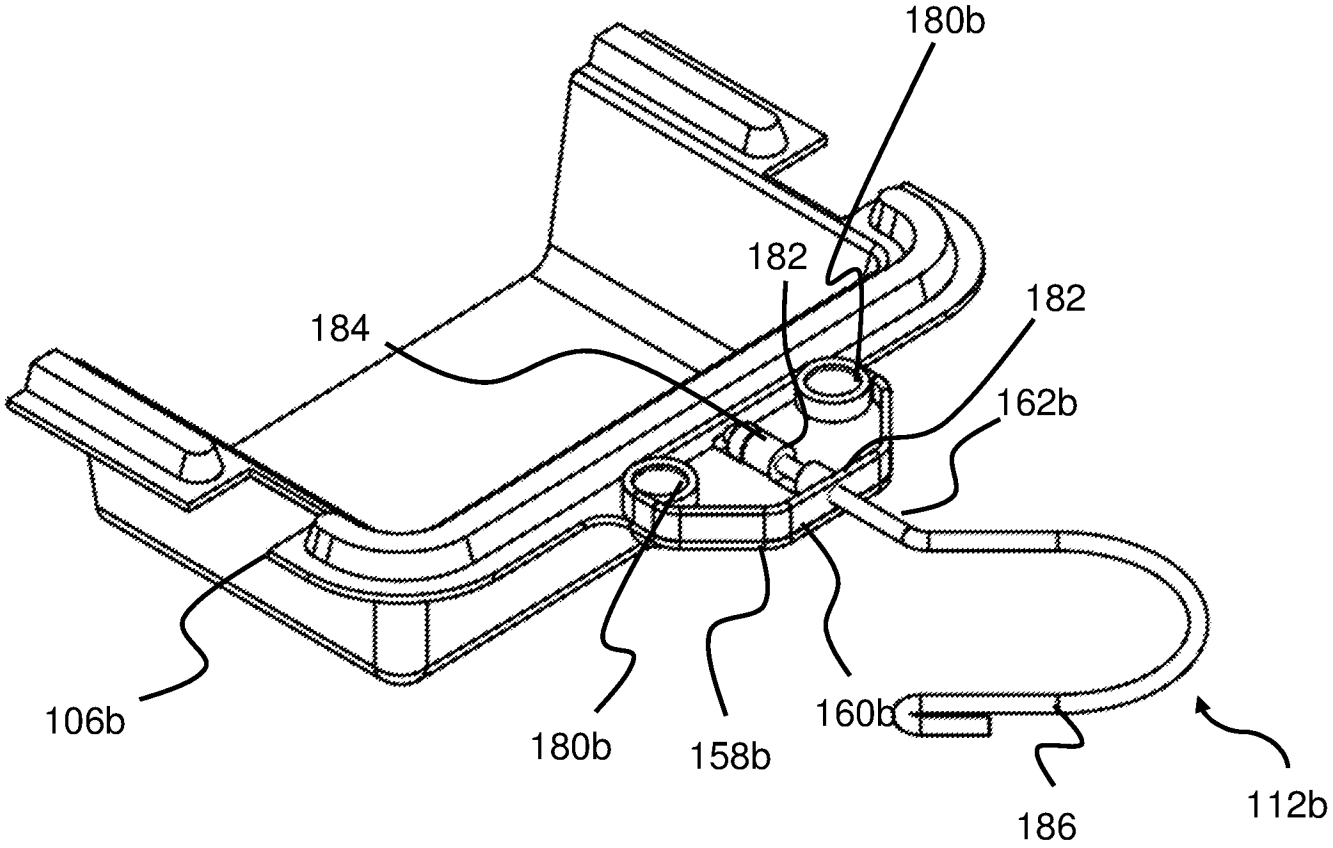
FIG. 23 is a fragmentary, isometric view of the assembly including the first shell and the swiveling hanger hook of a third illustrative embodiment herein.
Figure 24:
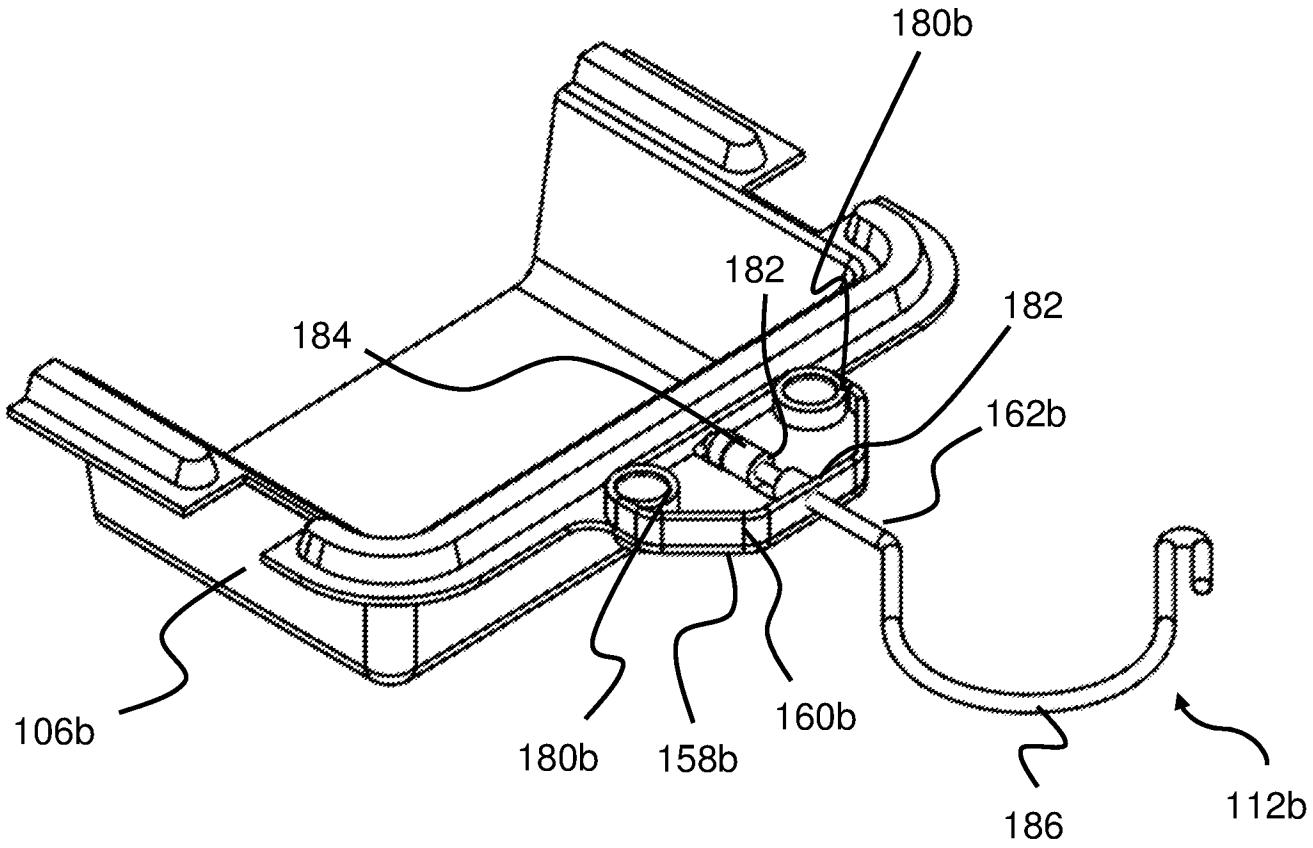
FIG. 24 is a fragmentary, isometric view of the assembly including the first shell and the swiveling hanger hook of the third illustrative embodiment herein showing the swiveling hanger hook in an alternative position.

Referring to FIGS. 23 and 24, yet another alternative embodiment of the storage device in accordance with the embodiments disclosed herein can be seen. The embodiment of FIGS. 23 and 24 is provided with a swiveling hook 112*b* that can swivel from side to side to allow a user to orient the outer shell of the storage device as desired relative to the hanging rod or pole without having to take the storage device off the hanging rod or pole, thus making it more convenient for the user to orient the outer shell as desired relative to the hanging rod or pole. Only a portion of the outer shell, namely the first shell 106*b*, is shown in FIGS. 23 and 24 because the remaining portions of the storage device 100*b* are identical to the corresponding portions of the storage device 100.

In the embodiment of FIGS. 23 and 24, the swiveling hook 112*b* has a shank 162*b* that is supported for rotation about its longitudinal axis by one or more sleeves 182 that are fixed to the base plate 160*b*. Each of the one or more sleeves 182 has a cylindrical bore that receives a portion of the shank 162*b* of the hook 112*b* such that the hook 112*b* can be rotated about the longitudinal axis of the shank 162*b* of the hook 112*b*. A retaining ring 186 is secured to the end of the shank 162*b* of the hook 112*b* that is located farthest from the hook-shaped portion 184 of the hook 112*b* to prevent the shank 162*b* of the hook 112*b* from being pulled out of the sleeves 182 of the base plate 160*b*. The retaining ring 186 may engage a groove (not shown) in the shank 162*b* of the hook 112*b*. Alternatively, at least one portion of the shank 162*b* of the hook 112*b*, located on a side of one the sleeves 182 that is opposite the side of the sleeve 182 that is nearest the hook-shaped portion 184 of the hook 112*b*, may be flattened by a punching operation to prevent the hook 112*b* from being separated from the base plate 160*b*. The hook 112*b* may be made by bending a piece of steel wire of sufficient thickness into the shape of a hook. The base plate 160*b* is secured to the hook attachment tab 158*b* of the first shell 106*b* using rivets 180*b* or sets of screws and nuts.

It should be noted that "approximate" and "approximately" as used herein are understood to encompass within them the exact thing, noun, or adjective that they refer to.

The exemplary embodiments disclosed herein are for illustrative purposes only and are not meant to be used to limit the scope of the claims of this pending application. Various modifications of the disclosed embodiments as well as alternatives to these embodiments will become apparent to persons skilled in the art without departing from the scope of the claims. It is therefore contemplated that the claims will cover any and all modifications or embodiments that fall within the fullest scope of the claims under applicable law.

The invention claimed is:

1. A storage device for storing at least one hat or cap, said storage device comprising:

an outer shell having at least one bulged portion, wherein said storage device is capable of assuming a closed configuration and an open configuration;

a pivotally movable closure that forms a portion of said outer shell in said closed configuration and is pivotally movable between an open position and a closed position relative to a portion of said outer shell that does not include said pivotally movable closure, wherein said open position of said pivotally movable closure corresponds to said open configuration of said outer shell, and wherein said closed position of said pivotally movable closure corresponding to said closed configuration of said outer shell, wherein said outer shell defines an enclosed space for storing the at least one hat or cap at least when said pivotally movable closure is in said closed position, and wherein said storage device has an interior comprising said enclosed space and said interior of said storage device is accessible when said pivotally movable closure is in said open position;

pivot means for allowing said pivotal movement of said pivotally movable closure relative to said portion of said outer shell that does not include said pivotally movable closure;

latch means for selectively securing said pivotally movable closure in said closed position; and at least one boss molded with said outer shell, wherein said at least one boss limits said pivotal movement of said pivotally movable closure relative to said portion of said outer shell that does not include said pivotally movable closure so as to limit a size of an opening in said storage device resulting from said pivotally movable closure being in said open position.

2. The storage device of claim 1, wherein said at least one boss is molded with said portion of said outer shell that does not include said pivotally movable closure, wherein said at least one boss engages said pivotally movable closure, when said pivotally movable closure is in said open position, in order to limit pivotal movement of said pivotally movable closure from said closed position to said open position to a predetermined angle.

3. The storage device of claim 1, further comprising a swivel hook secured to said outer shell.

4. A storage device for storing at least one hat or cap, said storage device comprising:

an outer shell having at least one bulged portion, wherein said storage device is capable of assuming a closed configuration and an open configuration;

a pivotally movable closure that forms a portion of said outer shell in said closed configuration and is pivotally movable between an open position and a closed position relative to a portion of said outer shell that does not include said pivotally movable closure, wherein said open position of said pivotally movable closure corresponds to said open configuration of said outer shell, and wherein said closed position of said pivotally movable closure corresponding to said closed configuration of said outer shell, wherein said outer shell defines an enclosed space for storing the at least one hat or cap at least when said pivotally movable closure is in said closed position, and wherein said storage device has an interior comprising said enclosed space and said interior of said storage device is accessible when said pivotally movable closure is in said open position;

pivot means for allowing said pivotal movement of said pivotally movable closure relative to said portion of said outer shell that does not include said pivotally movable closure;

latch means for selectively securing said pivotally movable closure in said closed position;

limit means for limiting said pivotal movement of said pivotally movable closure relative to said portion of said outer shell that does not include said pivotally movable closure so as to limit a size of an opening in said storage device resulting from said pivotally movable closure being in said open position; and a swivel hook secured to said outer shell.

5. The storage device of claim 4, further comprising at least one boss provided on said second shell, wherein said at least one boss engages said pivotally movable closure, when said pivotally movable closure is in said open position, in order to limit pivotal movement of said pivotally movable closure from said closed position to said open position to a predetermined angle.

6. The storage device of claim 4, wherein said predetermined angle is equal to or less than 90 degrees.

7. The storage device of claim 4, wherein said predetermined angle is an acute angle.

8. The storage device of claim 4, further comprising:

a first flange and a second flange, wherein said first flange extends along at least a portion of a perimeter of said open side of said first shell, wherein said second flange extends along at least a portion of a perimeter of said pivotally movable closure, and wherein one of said first flange and said second flange has a cutout; and a slide supported for rectilinear movement between a latched position and an unlatched position on one of said first flange and said second flange that does not have said cutout, wherein said slide captures portions of both said first flange and said second flange to keep said pivotally movable closure in said closed position when said slide is in said latched position, wherein said slide registers with said cutout so as to allow movement of said pivotally movable closure to said open position when said slide is in said unlatched position, and wherein said latch means comprises said cutout, said slide, and portions of said first flange and said second flange that define said cutout and are within a range covered by said slide in said latched position and said unlatched position and as said slide moves between said latched position and said unlatched position when said pivotally movable closure is in said closed position.

9. The storage device of claim 4, wherein said pivot means comprises a flexible portion of said second shell, wherein said flexible portion is connected to said pivotally movable closure, wherein said flexible portion is provided intermediate said pivotally movable closure and said boss, and wherein said flexible portion is capable of flexing to allow pivotal movement of said pivotally movable closure between said open position and said closed position.

10. The storage device of claim 4, wherein said storage device is capable of storing a plurality of hats and/or a plurality of caps stacked in a shingled arrangement, wherein each of the plurality of hats and/or the plurality of caps includes a head covering portion and a bill such that the plurality of hats and/or the plurality of caps stacked in the shingled arrangement have folded head covering portions, and wherein said bulged portion of said second shell is adapted to ensure that said enclosed space has at least a portion that is at least sufficiently large to accommodate the folded head covering portions of the plurality of hats and/or the plurality of caps stacked in the shingled arrangement.

11. A storage device for storing at least one hat or cap, said storage device comprising:

a first shell having an open side;

a second shell having an open side, wherein said storage device is capable of assuming a closed configuration and an open configuration, wherein said first shell and said second shell cooperatively define an enclosed space for storing the at least one hat or cap at least when said storage device is in said closed configuration, wherein said storage device has an interior comprising said enclosed space and said interior of said storage device is accessible when said storage device is in said open configuration, and wherein said open side of said first shell faces said open side of said second shell at least when said storage device is in said closed configuration;

at least one pivotally movable closure that is pivotally supported for pivotal movement between an open position and a closed position, wherein said pivotally movable closure forms at least a portion of at least one of said first shell and said second shell that is pivotally supported for pivotal movement between said open position and said closed position, wherein said pivotally movable closure being in said closed position at least when said storage device is in said closed configuration;

pivot means for allowing said pivotal movement of said pivotally movable closure;

limit means for limiting said pivotal movement of said pivotally movable closure so as to limit a size of an opening in said storage device resulting at least in part from said pivotally movable closure being in said open position;

a first flange and a second flange, wherein said first flange extends along at least a portion of a perimeter of at least a portion of one of said first shell and said second shell that is not formed by said pivotally movable closure, wherein said second flange extends along at least a portion of a perimeter of said pivotally movable closure, and wherein one of said first flange and said second flange has a cutout; and a slide supported for rectilinear movement between a latched position and an unlatched position on one of said first flange and said second flange that does not have said cutout, wherein said slide captures portions of both said first flange and said second flange to keep said pivotally movable closure in said closed position when said slide is in said latched position, wherein said slide registers with said cutout so as to allow movement of said pivotally movable closure to said open position when said slide is in said unlatched position, and wherein latch means is comprised of said cutout, said slide, and portions of said first flange and said second flange that define said cutout and are within a range covered by said slide in said latched position and said unlatched position and as said slide moves between said latched position and said unlatched position when said pivotally movable closure is in said closed position.

12. The storage device of claim 11, further comprising at least one boss, wherein said boss engages said pivotally movable closure, when said pivotally movable closure is in said open position, in order to limit pivotal movement of said pivotally movable closure from said closed position to said open position to a predetermined angle.

13. The storage device of claim 12, wherein said predetermined angle is equal to or less than 90 degrees.

14. The storage device of claim 12, wherein said predetermined angle is an acute angle.

15. The storage device of claim 12, wherein said at least one boss is molded with at least one of said first shell and said second shell.

16. The storage device of claim 12, wherein said pivot means comprises a flexible portion of at least one of said first shell and said second shell, wherein said flexible portion is connected to said pivotally movable closure, wherein said flexible portion is provided intermediate said pivotally movable closure and said at least one boss, and wherein said flexible portion is capable of flexing to allow pivotal movement of said pivotally movable closure between said open position and said closed position.

17. The storage device of claim 11, wherein said pivot means comprises a flexible portion of at least one of said first shell and said second shell, wherein said flexible portion is connected to said pivotally movable closure, and wherein said flexible portion is capable of flexing to allow pivotal movement of said pivotally movable closure between said open position and said closed position.

18. The storage device of claim 11, wherein at least one of the at least one hat or cap includes a head covering portion and a bill, and wherein at least one of said first shell and said second shell comprises a bulged portion such that said enclosed space has at least a portion that is at least sufficiently large to accommodate the head covering portion of at least one of the at least one hat or cap when the head covering portion is folded.

19. The storage device of claim 11, wherein said storage device is capable of storing a plurality of hats and/or a plurality of caps stacked in a shingled arrangement, wherein each of the plurality of hats and/or the plurality of caps includes a head covering portion and a bill such that the plurality of hats and/or the plurality of caps stacked in the shingled arrangement have folded head covering portions, and wherein at least one of said first shell and said second shell comprises a bulged portion such that said enclosed space has at least a portion that is at least sufficiently large to accommodate the folded head covering portions of the plurality of hats and/or the plurality of caps stacked in the shingled arrangement.

20. The storage device of claim 11, wherein said first shell and said second shell comprise a rail and rail channel cooperation to align said first shell and said second shell with respect to one another when said pivotally movable closure is in said closed position.

* * * * *